US005236817A

United States Patent [19]

Kim et al.

[11] Patent Number: 5,236,817

[45] Date of Patent: Aug. 17, 1993

[54] TABULAR GRAIN EMULSION CONTAINING REVERSAL PHOTOGRAPHIC ELEMENTS EXHIBITING IMPROVED SHARPNESS IN UNDERLYING LAYERS

[75] Inventors: Sang H. Kim, Pittsford; Mamie Kam-Ng; Allen K. Tsaur, both of Fairport; Jacob I. Cohen, Rochester; Richard A. Demauriac, Victor; George H. Hawks, III; John D. Baloga, both of Rochester, all of N.Y.

[73] Assignee: Eastman Kodak Company, Rochester, N.Y.

[21] Appl. No.: 860,664

[22] Filed: Mar. 30, 1992

Related U.S. Application Data

[63] Continuation-in-part of Ser. No. 846,306, Mar. 4, 1992, which is a continuation-in-part of Ser. No. 699,869, May 14, 1991, abandoned.

[51] Int. Cl.[5] ..... G03C 1/035; G03C 1/46

[52] U.S. Cl. ..... 430/503; 430/506; 430/567; 430/569; 430/637

[58] Field of Search ..... 430/503, 506, 567, 569, 430/637

[56] References Cited

U.S. PATENT DOCUMENTS

| | | | |
|---|---|---|---|
| 4,439,520 | 3/1984 | Kofron et al. | 430/567 |
| 4,582,781 | 4/1986 | Chen et al. | 430/527 |
| 4,656,122 | 4/1987 | Sowinski | 430/505 |
| 4,797,354 | 1/1989 | Saitou | 430/567 |
| 4,977,074 | 12/1990 | Saitou et al. | 430/567 |
| 5,043,259 | 8/1991 | Arai | 430/569 |
| 5,059,517 | 10/1991 | Ihama et al. | 430/567 |
| 5,096,806 | 3/1992 | Nakamura et al. | 430/567 |

FOREIGN PATENT DOCUMENTS 808228 1/1959 United Kingdom .

OTHER PUBLICATIONS

Research Disclosure, vol. 232, Aug. 1983, Item 23212.

*Primary Examiner*—Janet C. Baxter
*Attorney, Agent, or Firm*—Carl O. Thomas

[57] ABSTRACT

A multicolor photographic element capable of forming a viewable reversal dye image is disclosed comprising a support and, coated on the support, a blue recording yellow dye image forming layer unit, a green recording magenta dye image forming layer unit, and a red recording cyan dye image forming layer unit, each of the dye image forming layer units containing at least one silver halide emulsion layer comprised of a vehicle and silver halide grains having (1) a halide content of from 0 to 5 mole percent chloride, from 0.1 to 20 mole percent iodide, and from 80 to 99.9 mole percent bromide, based on total silver. At least one of the silver halide emulsion layers in one of the layer units positioned to receive exposing radiation prior to at least one of the green or red recording layer units is a tabular grain emulsion layer in which a polyalkylene oxide block copolymer is present selected to allow the preparation of tabular grains having a mean thickness of less than 0.3 μm and a mean tabularity of greater than 25, accounting for greater than 97 percent of the total projected area of grains having an equivalent circular diameter of at least 0.2 μm.

21 Claims, No Drawings

TABULAR GRAIN EMULSION CONTAINING REVERSAL PHOTOGRAPHIC ELEMENTS EXHIBITING IMPROVED SHARPNESS IN UNDERLYING LAYERS

This is a continuation-in-part of U.S. Ser. No. 846,306, filed Mar. 4, 1992, now pending, which is in turn a continuation-in part of U.S. Ser. No. 699,869, filed May 14, 1991, now abandoned.

FIELD OF THE INVENTION

The invention relates to improved photographic elements adapted for producing reversal dye images. More specifically, the invention relates to an improved dye image reversal photographic elements containing tabular grain emulsions.

BACKGROUND

The term "reversal photographic element" designates a photographic element which produces a photographic image for viewing by being imagewise exposed and developed to produce a negative of the image to be viewed, followed by uniform exposure and/or fogging of residual silver halide and processing to produce a second, viewable image. Color slides, such as those produced from Kodachrome TM and Ektachrome TM films, constitute a popular example of reversal photographic elements. In the overwhelming majority of applications the first image is negative and the second image is positive.

Although tabular grains had been observed in silver bromide and bromoiodide photographic emulsions dating from the earliest observations of magnified grains and grain replicas, it was not until the early 1980's that photographic advantages, such as improved speed-granularity relationships, more rapid developability, increased thermal stability, increased separation of blue and minus blue imaging speeds, and improved image sharpness in both mono- and multi-emulsion layer formats, were realized to be attainable from silver halide emulsions in which the majority of the total grain population based on grain projected area is accounted for by tabular grains satisfying the mean tabularity (T) relationship:

$$D/t^2 > 25$$

where

D is the equivalent circular diameter (ECD) in micrometers of the tabular grains and t is the thickness in micrometers of the tabular grains. Once photographic advantages were demonstrated with tabular grain silver bromide and bromoiodide emulsions techniques were devised to prepare tabular grains containing silver chloride alone or in combination with other silver halides.

Notwithstanding the many established advantages of tabular grain emulsions, the art has observed that these emulsions tend toward more disperse grain populations than can be achieved in the preparation of regular, untwinned grain populations—e.g., cubes, octahedra and cubo-octahedral grains. This has been a concern in some, but not all, photographic applications for tabular grain emulsions.

In the earliest tabular grain emulsions dispersity concerns were largely focused on the presence of significant populations of nonconforming grain shapes among the tabular grains conforming to the aim grain structure.

While the presence of nonconforming grain shapes in tabular grain emulsions has continued to detract from achieving narrow grain dispersities, as procedures for preparing tabular grains have been improved to reduce the inadvertent inclusion of nonconforming grain shapes, interest has increased in reducing the dispersity of the tabular grains.

The following are illustrative of tabular grain emulsions with relatively high levels of grain uniformity:

R-1 *Research Disclosure*, Vol. 232, August 1983, Item 23212 (Mignot French Patent 2,534,036, corresponding) discloses the preparation of silver bromide tabular grain emulsions with coefficients of variation ranging down to 15. *Research Disclosure* is published by Kenneth Mason Publications, Ltd., Dudley Annex, 21a North Street, Emsworth, Hampshire P010 7DQ, England. The tabular grain emulsion preparation technique has not been attractive for large scale emulsion manufacture because of the extended grain ripening periods required. The emulsion preparation process is further limited in that is applicable only to the preparation of silver bromide emulsions.

R-2 Saitou et al U.S. Pat. No. 4,797,354 reports in Example 9 a silver bromide tabular grain emulsion containing a relatively high proportion of hexagonal tabular grains. Low levels of grain dispersities have been demonstrated only in the preparation of silver bromide emulsions.

The following are illustrative of the incorporation of tabular grain emulsions in multicolor photographic elements:

R-3 Kofron et al U.S. Pat. No. 4,439,520 illustrates the incorporation of high aspect ratio ($D/t > 8$) tabular grain emulsions in multicolor photographic elements. Kofron et al reports improved speed-granularity relationships, increased image sharpness and reduced blue contamination of minus blue (green and/or red) records.

R-4 Sowinski et al U.S. Pat. No. 4,656,122, which specifically addresses color reversal photographic elements, has reported increased threshold imaging speeds, reduced toe region density, increased maximum density and increased contrast to result from blending a smaller grain emulsion with a tabular grain emulsion, thereby increasing the overall dispersity of the resulting emulsion.

Only limited use of high tabularity emulsions in color reversal photographic elements has occurred prior to the present invention. The result has been color photographic elements with higher levels of image granularity, lower dye image contrast and lower levels of image sharpness than optimum.

Interestingly, the most common multicolor photographic element format coats a yellow dye image forming layer unit over each of magenta and cyan dye image forming layer units with nontabular grain emulsions being employed in the yellow dye image forming layer unit. This is Layer Order Arrangement I of Kofron et al, and, as clearly taught by Kofron et al, the presence of nontabular grains in an overlying dye image forming layer unit degrades the sharpness of the dye image obtained in each of the underlying magenta and cyan dye image forming layer units.

CROSS-REFERENCED FILINGS

The following commonly assigned patent are cross-referenced:

Tsaur and Kam-Ng U.S. Ser. No. 700,220, filed May 14, 1991, titled PROCESS OF PREPARING A REDUCED DISPERSITY TABULAR GRAIN EMULSION, now U.S. Pat. No. 5,147,771, discloses a process for the preparation of tabular grain emulsions of reduced dispersity that employs an alkylene oxide block copolymer surfactant that contains two terminal lipophilic block units joined by a central hydrophilic block unit.

Tsaur and Kam-Ng U.S. Ser. No. 700,019, filed May 14, 1991, titled PROCESS OF PREPARING A REDUCED DISPERSITY TABULAR GRAIN EMULSION, now U.S. Pat. No. 5,171,659, discloses a process for the preparation of tabular grain emulsions of reduced dispersity that employs an alkylene oxide block copolymer surfactant that contains two terminal hydrophilic block units joined by a central lipophilic block unit.

Tsaur and Kam-Ng U.S. Ser. No. 699,851, filed May 14, 1991, titled PROCESS OF PREPARING A REDUCED DISPERSITY TABULAR GRAIN EMULSION, now U.S. Pat. No. 5,147,773, discloses a process for the preparation of tabular grain emulsions of reduced dispersity that employs an alkylene oxide block copolymer surfactant that contains at least three terminal hydrophilic block units joined by a central lipophilic block linking unit.

Tsaur and Kam-Ng U.S. Ser. No. 700,020, filed May 14, 1991, titled PROCESS OF PREPARING A REDUCED DISPERSITY TABULAR GRAIN EMULSION, now U.S. Pat. No. 5,147,772, discloses a process for the preparation of tabular grain emulsions of reduced dispersity that employs an alkylene oxide block copolymer surfactant that contains at least three terminal lipophilic block units joined by a central hydrophilic block linking unit.

Tsaur and Kam-Ng U.S. Ser. No. 699,855, filed May 14, 1991, titled A VERY LOW COEFFICIENT OF VARIATION TABULAR GRAIN EMULSION, now allowed, discloses a coprecipitated grain population having a coefficient of variation of less than 10 percent and consisting essentially of tabular grains.

Loblaw, Tsaur and Kam-Ng U.S. Ser. No. 700,228, filed May 14, 1991, (now abandoned and refiled as U.S. Ser. No. 849,928, Mar. 12, 1992) titled IMPROVED PHOTOTYPESETTING PAPER discloses a phototypesetting paper containing a tabular grain emulsion having a coefficient of variation of less than 15 percent.

Dickerson and Tsaur U.S. Ser. No. 699,840, filed May 14, 1991, (now abandoned and refiled as U.S. Ser. No. 849,917, Mar. 12, 1992) titled RADIOGRAPHIC ELEMENTS WITH IMPROVED DETECTIVE QUANTUM EFFICIENCIES discloses a dual coated radiographic element containing a tabular grain emulsion having a coefficient of variation of less than 15 percent.

SUMMARY OF THE INVENTION

This invention has as its purpose to provide a multicolor photographic element capable of forming a viewable reversal dye image of improved photographic quality. It is particularly contemplated to provide such a color reversal photographic element in which the sharpness and contrast are enhanced in a overlying dye image forming layer unit, such as yellow dye image forming layer unit, and image sharpness is concurrently enhanced in at least one underlying dye image forming layer unit—e.g. a cyan dye image forming layer unit.

In one aspect, this invention is directed to a multicolor photographic element capable of forming a viewable reversal dye image comprising a support and, coated on said support, a blue recording yellow dye image forming layer unit, a green recording magenta dye image forming layer unit, and a red recording cyan dye image forming layer unit, each of the dye image forming layer units containing at least one silver halide emulsion layer comprised of a vehicle and silver halide grains having a halide content of from 0 to 5 mole percent chloride, from 0.1 to 20 mole percent iodide, and from 80 to 99.9 mole percent bromide, based on total silver.

The invention is characterized in that at least one of the silver halide emulsion layers in one of the layer units positioned to receive exposing radiation prior to at least one of the green or red recording layer units is a tabular grain emulsion layer in which a polyalkylene oxide block copolymer is present selected to satisfy one of the formulae $$\text{LAO1—HAO1—LAO1,} \quad \text{(S-I)}$$

$$\text{HAO2—LAO2—HAO2,} \quad \text{(S-II)}$$

$$(\text{H—HAO3})_z\text{—LOL—}(\text{HAO3—H})_{z'}\text{, and} \quad \text{(S-III)}$$

$$(\text{H—LAO4})_z\text{—HOL—}(\text{LAO4—H})_{z'} \quad \text{(S-IV)}$$

where

LAO1 and LAO4 in each occurrence represents a terminal lipophilic alkylene oxide block unit, HAO2 and HAO3 in each occurrence presents a terminal hydrophilic alkylene oxide block unit, HAO1 and HOL each represents a hydrophilic alkylene oxide block linking unit, LAO2 and LOL each represents a lipophilic alkylene oxide block linking unit, z is 2, and z' is 1 or 2, each block linking unit constitutes from 4 to 96 percent of the block copolymer on a weight basis, the block copolymer S-I has a molecular weight of from 760 to less than 16,000, the block copolymer S-II has a molecular weight of from 1,000 to 30,000, the block copolymer S-III has a molecular weight of from 1,100 to 60,000, and the block copolymer S-IV has a molecular weight of from 1,100 to 50,000, the tabular grains account for greater than 97 percent of the total projected area of grains having an equivalent circular diameter of at least 0.2 μm and the tabular grains have a mean thickness of less than 0.3 μm and a mean tabularity of greater than 25.

DESCRIPTION OF PREFERRED EMBODIMENTS

The invention relates to an improvement in silver halide photographic elements useful in reversal dye imaging. The reversal photographic elements are comprised of a support and one or more blue recording yellow dye image forming layer units, one or more green recording magenta dye image forming layer units, and one or more red recording cyan dye image forming layer units. Any conventional arrangement of layer units can be employed, including particularly any of those set forth by Kofron et al U.S. Pat. No. 4,439,520.

Each of the emulsion layer units contains at least one silver halide emulsion layer. It is common practice to construct an emulsion layer unit of a faster emulsion layer coated over a slower emulsion layer, and in many instances three emulsion layers are present within a single emulsion layer unit. Each of the layer units contain in at least one layer and, preferably, each of its layers, a silver halide emulsion having a grain halide content of from 0 to 5 mole percent chloride, from 0.1 to 20 mole percent iodide, and from 80 to 99.9 mole percent bromide, based on total silver. Iodide is essential to achieving high levels of sensitivity and advantageous interimage effects. Preferred levels of iodide typically range from about 1 to 15 mole percent and are optimally less than 10 mole percent, based on total silver. Low levels of chloride can be tolerated within the grains. The chloride ion here referred to is that which forms a solid solution with the silver bromide in the crystal structure and does not include epitaxial silver chloride, which is viewed as a grain sensitizer, rather than as a part of the grain structure. Conventionally silver bromoiodide emulsions have been most extensively employed in reversal imaging, and these are particularly contemplated for use in the practice of the invention.

At least one of the emulsions in at least one of the dye image forming layer units overlying at least one other dye image forming layer unit is a high tabularity ($D/t^2>25$), high specularity tabular grain emulsion. As employed herein the term "high specularity" is intended to designate emulsions in which greater than 97 percent (optimally greater than 98 percent) of the total projected area of grains having an equivalent circular diameter of at least 0.2 μm (optimally at least 0.15 μm) is accounted for by tabular grains. The reason for excluding grains having an equivalent circular diameter of less than 0.2 μm is that these relatively fine grains exhibit minimal scattering of visible light, particularly light in the minus blue (500 to 700 nm—i.e., the green and red) wavelength range. In the equivalent circular diameter range of from less than 0.2 μm to 0.15 μm silver halide grains exhibit a limited capability for scattering light in the blue (400 to 500 nm) region of the visible and are preferably included in determining the tabular grain projected area percentages above when an underlying emulsion layer is intended to record blue light. High specularity is attributed to the very limited percentage of the emulsion grains accounted for by nontabular grains, once grains too small to scatter light are excluded. When precipitated by the procedures herein described, the high tabularity, high specularity emulsions of the invention contain negligible, if any, grains having equivalent circular diameters of less than 0.2 μm. It is, however, recognized that it is common practice to blend into photographic emulsions for various purposes fine grain emulsions to achieve modified photographic properties. For example, Lippmann emulsions, mean grain diameters typically being about 0.05 μm, are commonly blended into silver halide emulsions to modify characteristic curve shape. Fine grain emulsions are also taught to be incorporated by Sowinski et al U.S. Pat. No. 4,656,122, cited above and here incorporated by reference. By maximizing the proportion of tabular grains present in the grain size ranges capable of scattering light the specularity of light transmission is increased. This enhances imaging sharpness within the high tabularity, high specularity emulsion layer and in underlying image forming layer units as well.

While a single high tabularity, high specularity tabular grain emulsion provides one or more of the imaging advantages noted above when located in any layer of any one of the dye image forming layer units, to improve the imaging sharpness of another layer unit as well the high tabularity, high specularity tabular grain emulsion layer is located in at least one dye image forming layer unit which receives exposing radiation prior to at least one other dye image forming layer unit. In other words, since photographic elements are not commonly exposed through the support, the high tabularity, high specularity emulsion layer is located farther from the support than at least one other emulsion layer unit. In this location the emulsion contributes to increasing the image sharpness of each of the underlying layer units of the reversal photographic element. In the most common arrangement of layer units, the high tabularity, high specularity tabular grain emulsion layer is preferably located in the blue recording dye image forming layer unit. When the blue recording dye image forming layer unit is formed of two or more superimposed emulsion layers differing in speed, the high tabularity, high specularity emulsion can be present in any or all of the emulsion layers. However, in film construction nontabular grains are sometimes used to form the fastest blue recording emulsion layer to maximize blue speed. In this instance the high tabularity, high specularity emulsion of the invention is located in one or more of the underlying, slower blue recording emulsion layers. It is contemplated to place the high tabularity, high specularity emulsions in each or any desired combination of the dye image forming layer units. Within the dye image forming layer units the high tabularity, high specularity emulsions can constitute each and every emulsion layer.

The reversal dye image forming photographic elements of this invention have been realized by the discovery and optimization of novel processes for the precipitation of high tabularity, high specularity tabular grain emulsions. Grain populations consisting essentially of tabular grains having mean thicknesses in the range of from 0.070 to 0.3 μm and mean tabularities (as defined above) of greater than 25 are well within the capabilities of the precipitation procedures set forth below. These ranges permit any mean tabular grain ECD to be selected appropriate for the photographic application. In other words, the present invention is compatible with the full range of mean ECDs of conventional tabular grain emulsions. A mean ECD of about 10 μm is typically regarded as the upper limit for photographic utility. For most applications the tabular grains exhibit a mean ECD of 5 μm or less. Since increased ECDs contribute to achieving higher mean aspect ratios and tabularities, it is generally preferred that mean ECDs of the tabular grains be at least about 0.4 μm. When the high tabularity, high specularity emulsions are present in the blue recording layer unit, the tabular grains as well as any spectral sensitizing dye, if present, can be relied upon to absorb blue light. In the blue recording layer unit tabular grain thicknesses of up to 0.3 μm or even higher can be employed, although it is usually preferred to limit mean tabular grain thicknesses to less than 0.2 μm to increase mean tabularities and to increase the specular transmittance of green and red light. In the green and red recording layer units almost all absorbed green or red light is absorbed by spectral sensitizing dye rather than by the tabular grains, and it is therefore preferred that the tabular grains exhibit a thickness of less than 0.2 μm, with even thinner tabular grains—e.g. less than 0.1 μm being contemplated.

Any mean tabular grain aspect ratio within the mean tabular grain thickness and tabularity ranges indicated is contemplated. Mean tabular grain aspect ratios for the tabular grains preferably range from 3 to 100 or more. For the majority of photographic applications mean tabular grain aspect ratios in the range of from about 5 to 50 are most practical.

While mean aspect ratios have been most extensively used in the art to characterize dimensionally tabular grain emulsions, mean tabularities ($D/t^2$, as defined) provide an even better quantitative measure of the qualities that set tabular grain populations apart from nontabular grain populations. The emulsions of the invention contain exhibit tabularities of greater than 25. Typically mean tabularities of the tabular grain emulsions range up to about 500. Since tabularities are increased exponentially with decreased tabular grain mean thicknesses, extremely high tabularities can be realized ranging up to 1000 or more.

The high tabularity, high specularity emulsions employed in the reversal photographic elements of this invention can be prepared with grain dispersities are far lower than have been heretofore realized in the art. High tabularity, high specularity emulsions with low grain dispersity are preferred, but are not required to achieve high levels of image sharpness in underlying emulsion layer units.

So long as the high tabularity, high specularity emulsions satisfy the tabular grain projected area percentages described above variances in grain coefficients of variation (COV) do not have large effects on the sharpness of underlying dye image forming layer units. As employed herein the term "coefficient of variation" or "COV" refers to the standard deviation of the grain population divided by the mean ECD of the grain population. Emulsion COV based on the total grain population (tabular and nontabular grains) having a diameter of least 0.2 μm can range up to 30 percent with little impact on underlying layer unit sharpness. However, to achieve the highest possible image sharpness not only in the underlying dye image forming layer units, but also in the high tabularity, high specularity emulsion containing dye image forming layer unit, it is preferred that the COV of the high tabularity, high specularity emulsion layer or layers be kept low. The high tabularity, high specularity emulsions preferably exhibit a COV of less than 15 percent and optimally less than 10 percent, based on the entire grain population present in the emulsion. Since prior art emulsions have commonly contained relatively high proportions of nontabular grains, low COV numbers reported in the art for tabular grain emulsions often exclude nontabular grains. Such COV's are, of course, not comparable to those that are based on a total grain population having an ECD of at least 0.2 μm.

In addition the high specularity emulsions employed in the practice of this invention preferably also exhibit low grain-to-grain variations in the thicknesses of the coprecipitated tabular grain population. This has been observed by the low chromatic variances of light reflections from the tabular grain population. Tabular grain emulsions have been prepared in which the majority of the tabular grains are of one hue or closely related family of hues. Tabular grain emulsions satisfying the requirements of this invention have been prepared in which the majority of the tabular grains are either white, yellow, buff, brown, purple, blue, cyan, green, orange, magenta or red. From these observations it has been determined that the high specularity emulsions of this invention can be prepared with greater than 50 percent, preferably greater than 70 percent and optimally greater than 90 percent of the total tabular grain projected area exhibiting a hue indicative of thickness variations within ±0.01 μm of the mean tabular grain thickness.

By having tabular grain populations of more uniform thickness it is possible to achieve more efficient multicolor imaging. For example, the tabular grains of the blue recording emulsion layer unit can be selected to have a thickness which preferentially absorbs blue light and exhibits a high level of transmission of green and red light to underlying layers. Since there is more grain-to-grain uniformity in the tabular grains, less of the green and red light is reflected in the blue recording layer unit by tabular grains of anomalous thicknesses. Similarly, an underlying green recording layer unit can contain tabular grains which more uniformly transmit red light to an underlying red recording emulsion layer unit or reflect blue light back to the overlying blue recording layer unit. Even the layer unit nearest the support, usually the red recording layer unit, can benefit in its imaging properties by containing a tabular grain population of more uniform thickness. The red recording layer unit can have the tabular grain thicknesses chosen to reflect more uniformly either blue or green light.

The emulsions contemplated for use have been made available by the discovery and optimization of improved processes for the preparation of tabular grain emulsions by (a) first forming a population of grain nuclei, (b) ripening out a portion of the grain nuclei in the presence of a ripening agent, and (c) undertaking post-ripening grain growth. Coprecipitated grain population emulsions consisting essentially of tabular grains satisfying the requirements of this invention has resulted from the discovery of specific techniques for forming the population of grain nuclei.

The first step is to undertake formation of the silver halide grain nuclei under conditions that promote uniformity. Prior to forming the grain nuclei bromide ion is added to the dispersing medium. Although other halides can be added to the dispersing medium along with silver, prior to introducing silver, halide ions in the dispersing medium consist essentially of bromide ions.

The balanced double jet precipitation of grain nuclei is specifically contemplated in which an aqueous silver salt solution and an aqueous bromide salt are concurrently introduced into a dispersing medium containing water and a hydrophilic colloid peptizer. One or both of chloride and iodide salts can be introduced through the bromide jet or as a separate aqueous solution through a separate jet. It is preferred to limit the concentration of chloride and/or iodide to the overall levels described above or less during grain nucleation. Silver nitrate is the most commonly utilized silver salt while the halide salts most commonly employed are ammonium halides and alkali metal (e.g., lithium, sodium or potassium) halides. The ammonium counter ion does not function as a ripening agent since the dispersing medium is at an acid pH—i.e., less than 7.0.

Instead of introducing aqueous silver and halide salts through separate jets a uniform nucleation can be achieved by introducing a Lippmann emulsion into the dispersing medium. Since the Lippmann emulsion grains typically have a mean ECD of less than 0.05 μm, a small fraction of the Lippmann grains initially introduced serve as deposition sites while all of the remaining Lippmann grains dissociate into silver and halide ions that precipitate onto grain nuclei surfaces. Techniques for using small, preformed silver halide grains as a feedstock for emulsion precipitation are illustrated by Mignot U.S. Pat. No. 4,334,012; Saito U.S. Pat. No. 4,301,241; and Solberg et al U.S. Pat. No. 4,433,048.

The high tabularity, high specularity emulsions contemplated for use can be prepared by producing prior to ripening a population of parallel twin plane containing grain nuclei in the presence of selected surfactants. Specifically, it has been discovered that the dispersity of the tabular grain emulsions of this invention can be reduced by introducing parallel twin planes in the grain nuclei in the presence of one or a combination of polyalkylene oxide block copolymer surfactants. Polyalkylene oxide block copolymer surfactants generally and those contemplated for use in preparing the emulsions of this invention in particular are well known and have been widely used for a variety of purposes. They are generally recognized to constitute a major category of nonionic surfactants. For a molecule to function as a surfactant it must contain at least one hydrophilic unit and at least one lipophilic unit linked together. A general review of block copolymer surfactants is provided by I. R. Schmolka, "A Review of Block Polymer Surfactants", J. Am. Oil Chem. Soc., Vol. 54, No. 3, 1977, pp. 110–116, and A. S. Davidsohn and B. Milwidsky, *Synthetic Detergents*, John Wiley & Sons, N.Y. 1987, pp. 29–40, and particularly pp. 34–36, the disclosures of which are here incorporated by reference.

One category of polyalkylene oxide block copolymer surfactant found to be useful in the preparation of the emulsions is comprised of two terminal lipophilic alkylene oxide block units linked by a hydrophilic alkylene oxide block unit accounting for at least 4 percent of the molecular weight of the copolymer. These surfactants are hereinafter referred to category S-I surfactants.

The category S-I surfactants contain at least two terminal lipophilic alkylene oxide block units linked by a hydrophilic alkylene oxide block unit and can be, in a simple form, schematically represented as indicated by diagram I below:

| | | | |
|---|---|---|---|
| (I) | LAO1 | HAO1 | LAO1 |

where

LAO1 in each occurrence represents a terminal lipophilic alkylene oxide block unit and HAO1 represents a linking hydrophilic alkylene oxide block unit.

It is generally preferred that HAO1 be chosen so that the hydrophilic block unit constitutes from 4 to 96 percent of the block copolymer on a total weight basis.

It is, of course, recognized that the block diagram I above is only one example of a polyalkylene oxide block copolymer having at least two terminal lipophilic block units linked by a hydrophilic block unit. In a common variant structure interposing a trivalent amine linking group in the polyalkylene oxide chain at one or both of the interfaces of the LAO1 and HAO1 block units can result in three or four terminal lipophilic groups.

In their simplest possible form the category S-I polyalkylene oxide block copolymer surfactants are formed by first condensing ethylene glycol and ethylene oxide to form an oligomeric or polymeric block repeating unit that serves as the hydrophilic block unit and then completing the reaction using 1,2-propylene oxide. The propylene oxide adds to each end of the ethylene oxide block unit. At least six 1,2-propylene oxide repeating units are required to produce a lipophilic block repeating unit. The resulting polyalkylene oxide block copolymer surfactant can be represented by formula II:

$$HO-(\overset{\overset{CH_3}{|}}{C}HCH_2O)_x-(CH_2CH_2O)_y-(CH_2\overset{\overset{CH_3}{|}}{C}HO)_{x'}-H \qquad (II)$$

where x and x' are each at least 6 and can range up to 120 or more and y is chosen so that the ethylene oxide block unit maintains the necessary balance of lipophilic and hydrophilic qualities necessary to retain surfactant activity. It is generally preferred that y be chosen so that the hydrophilic block unit constitutes from 4 to 96 percent by weight of the total block copolymer. Within the above ranges for x and x', y can range from 2 to 300 or more.

Generally any category S-I surfactant block copolymer that retains the dispersion characteristics of a surfactant can be employed. It has been observed that the surfactants are fully effective either dissolved or physically dispersed in the reaction vessel. The dispersal of the polyalkylene oxide block copolymers is promoted by the vigorous stirring typically employed during the preparation of tabular grain emulsions. In general surfactants having molecular weights of less than about 16,000, preferably less than about 10,000, are contemplated for use.

In a second category, hereinafter referred to as category S-II surfactants, the polyalkylene oxide block copolymer surfactants contain two terminal hydrophilic alkylene oxide block units linked by a lipophilic alkylene oxide block unit and can be, in a simple form, schematically represented as indicated by diagram III below:

| | | | |
|---|---|---|---|
| (III) | HAO1 | LAO1 | HAO1 |

where

HAO2 in each occurrence represents a terminal hydrophilic alkylene oxide block unit and LAO2 represents a linking lipophilic alkylene oxide block unit.

It is generally preferred that LAO2 be chosen so that the lipophilic block unit constitutes from 4 to 96 percent of the block copolymer on a total weight basis.

It is, of course, recognized that the block diagram III above is only one example of a category S-II polyalkylene oxide block copolymer having at least two terminal hydrophilic block units linked by a lipophilic block unit. In a common variant structure interposing a trivalent amine linking group in the polyalkylene oxide chain at one or both of the interfaces of the LAO2 and HAO2 block units can result in three or four terminal hydrophilic groups.

In their simplest possible form the category S-II polyalkylene oxide block copolymer surfactants are formed by first condensing 1,2-propylene glycol and 1,2-propylene oxide to form an oligomeric or polymeric block repeating unit that serves as the lipophilic block unit and then completing the reaction using ethylene oxide.

Ethylene oxide is added to each end of the 1,2-propylene oxide block unit. At least thirteen (13) 1,2-propylene oxide repeating units are required to produce a lipophilic block repeating unit. The resulting polyalkylene oxide block copolymer surfactant can be represented by formula IV:

$$HO-(CH_2CH_2O)_y-(\overset{\overset{CH_3}{|}}{C}HCH_2O)_x-(CH_2CH_2O)_{y'}-H \quad (IV)$$

where x is at least 13 and can range up to 490 or more and y and y' are chosen so that the ethylene oxide block units maintain the necessary balance of lipophilic and hydrophilic qualities necessary to retain surfactant activity. It is generally preferred that x be chosen so that the lipophilic block unit constitutes from 4 to 96 percent by weight of the total block copolymer; thus, within the above range for x, y and y' can range from 1 to 320 or more.

Any category S-II block copolymer surfactant that retains the dispersion characteristics of a surfactant can be employed. It has been observed that the surfactants are fully effective either dissolved or physically dispersed in the reaction vessel. The dispersal of the polyalkylene oxide block copolymers is promoted by the vigorous stirring typically employed during the preparation of tabular grain emulsions. In general surfactants having molecular weights of less than about 30,000, preferably less than about 20,000, are contemplated for use.

In a third category, hereinafter referred to as category S-III surfactants, the polyalkylene oxide surfactants contain at least three terminal hydrophilic alkylene oxide block units linked through a lipophilic alkylene oxide block linking unit and can be, in a simple form, schematically represented as indicated by formula V below:

$$(H-HAO3)_z-LOL-(HAO3-H)_{z'} \quad (V)$$

where

HAO3 in each occurrence represents a terminal hydrophilic alkylene oxide block unit, LOL represents a lipophilic alkylene oxide block linking unit, z is 2 and z' is 1 or 2.

The polyalkylene oxide block copolymer surfactants employed can take the form shown in formula VI:

$$(H-HAO3-LAO3)_z-L-(LAO3-HAO3-H)_{z'} \quad (VI)$$

where

HAO3 in each occurrence represents a terminal hydrophilic alkylene oxide block unit, LAO3 in each occurrence represents a lipophilic alkylene oxide block unit, L represents a linking group, such as amine or diamine, z is 2 and z' is 1 or 2.

The linking group L can take any convenient form. It is generally preferred to choose a linking group that is itself lipophilic. When z+z' equal three, the linking group must be trivalent. Amines can be used as trivalent linking groups. When an amine is used to form the linking unit L, the polyalkylene oxide block copolymer surfactants employed can take the form shown in formula VII:

$$\begin{array}{c} (R^1)_a-LAO3-HAO3-H \\ | \\ N \\ / \quad \backslash \\ H-HAO3-LAO3-(R^2)_b \quad (R^3)_c-LAO3-HAO3-H \end{array} \quad (VII)$$

where

HAO3 and LAO3 are as previously defined;

$R^1$, $R^2$ and $R^3$ are independently selected hydrocarbon linking groups, preferably phenylene groups or alkylene groups containing from 1 to 10 carbon atoms; and a, b and c are independently zero or 1. To avoid steric hindrances it is generally preferred that at least one (optimally at least two) of a, b and c be 1. An amine (preferably a secondary or tertiary amine) having hydroxy functional groups for entering into an oxyalkylation reaction is a contemplated starting material for forming a polyalkylene oxide block copolymer satisfying formula VII.

When z+z' equal four, the linking group must be tetravalent. Diamines are preferred tetravalent linking groups. When a diamine is used to form the linking unit L, the polyalkylene oxide block copolymer surfactants employed can take the form shown in formula VIII:

$$\begin{array}{ccc} H-HAO3-LAO3-(R^5)_e & & (R^8)_g-LAO3-HAO3-H \\ & \backslash \quad / & \\ & N-R^6-N & \\ & / \quad \backslash & \\ H-HAO3-LAO3-(R^4)_d & & (R^7)_f-LAO3-HAO3-H \end{array} \quad (VIII)$$

where

HAO3 and LAO3 are as previously defined;

$R^4$, $R^5$, $R^6$, $R^7$ and $R^8$ are independently selected hydrocarbon linking groups, preferably phenylene groups or alkylene groups containing from 1 to 10 carbon atoms; and d, e, f and g are independently zero or 1. It is generally preferred that LAO3 be chosen so that the LOL lipophilic block unit accounts for from 4 to less than 96 percent, preferably from 15 to 95 percent, optimally 20 to 90 percent, of the molecular weight of the copolymer.

In a fourth category, hereinafter referred to as category S-IV surfactants, the polyalkylene oxide block copolymer surfactants employed contain at least three terminal lipophilic alkylene oxide block units linked through a hydrophilic alkylene oxide block linking unit and can be, in a simple form, schematically represented as indicated by formula IX below:

$$(H-LAO4)_z-HOL-(LAO4-H)_{z'} \quad (IX)$$

where

LAO4 in each occurrence represents a terminal lipophilic alkylene oxide block unit, HOL represents a hydrophilic alkylene oxide block linking unit, z is 2 and z' is 1 or 2.

The polyalkylene oxide block copolymer surfactants employed can take the form shown in formula X:

$$(H-LAO4-HAO4)_z-L'-(HAO4-LAO4-H)_{z'} \quad (X)$$

where

HAO4 in each occurrence represents a hydrophilic alkylene oxide block unit,

LAO4 in each occurrence represents a terminal lipophilic alkylene oxide block unit, L' represents a linking group, such as amine or diamine, z is 2 and z' is 1 or 2.

The linking group L' can take any convenient form. It is generally preferred to choose a linking group that is itself hydrophilic. When z+z' equal three, the linking group must be trivalent. Amines can be used as trivalent linking groups. When an amine is used to form the linking unit L', the polyalkylene oxide block copolymer surfactants employed can take the form shown in formula XI:

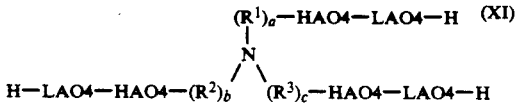

(XI)

where

HAO4 and LAO4 are as previously defined;

$R^1$, $R^2$ and $R^3$ are independently selected hydrocarbon linking groups, preferably phenylene groups or alkylene groups containing from 1 to 10 carbon atoms; and a, b and c are independently zero or 1. To avoid steric hindrances it is generally preferred that at least one (optimally at least two) of a, b and c be 1. An amine (preferably a secondary or tertiary amine) having hydroxy functional groups for entering into an oxyalkylation reaction is a contemplated starting material for forming a polyalkylene oxide block copolymer satisfying formula XI.

When z+z' equal four, the linking group must be tetravalent. Diamines are preferred tetravalent linking groups. When a diamine is used to form the linking unit L', the polyalkylene oxide block copolymer surfactants employed can take the form shown in formula XII:

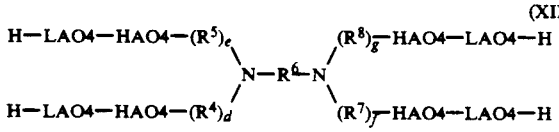

(XII)

where

HAO4 and LAO4 are as previously defined;

$R^4$, $R^5$, $R^6$, $R^7$ and $R^8$ are independently selected hydrocarbon linking groups, preferably phenylene groups or alkylene groups containing from 1 to 10 carbon atoms; and d, e, f and g are independently zero or 1. It is generally preferred that LAO4 be chosen so that the HOL hydrophilic block unit accounts for from 4 to 96 percent, preferably from 5 to 85 percent, of the molecular weight of the copolymer.

In their simplest possible form the polyalkylene oxide block copolymer surfactants of categories S-III and S-IV employ ethylene oxide repeating units to form the hydrophilic (HAO3 and HAO4) block units and 1,2-propylene oxide repeating units to form the lipophilic (LAO3 and LAO4) block units. At least three propylene oxide repeating units are required to produce a lipophilic block repeating unit. When so formed, each H—HAO3—LAO3— or H—LAO4—HAO4— group satisfies formula XIIIa or XIIIb, respectively:

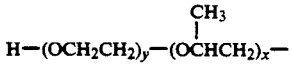

(XIIIa)

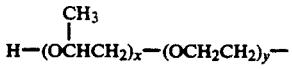

(XIIIb)

where x is at least 3 and can range up to 250 or more and y is chosen so that the ethylene oxide block unit maintains the necessary balance of lipophilic and hydrophilic qualities necessary to retain surfactant activity. This allows y to be chosen so that the hydrophilic block units together constitute from greater than 4 to 96 percent (optimally 10 to 80 percent) by weight of the total block copolymer. In this instance the lipophilic alkylene oxide block linking unit, which includes the 1,2-propylene oxide repeating units and the linking moieties, constitutes from 4 to 96 percent (optimally 20 to 90 percent) of the total weight of the block copolymer. Within the above ranges, y can range from 1 (preferably 2) to 340 or more.

The overall molecular weight of the polyalkylene oxide block copolymer surfactants of categories S-III and S-IV have a molecular weight of greater than 1100, preferably at least 2,000. Generally any such block copolymer that retains the dispersion characteristics of a surfactant can be employed. It has been observed that the surfactants are fully effective either dissolved or physically dispersed in the reaction vessel. The dispersal of the polyalkylene oxide block copolymers is promoted by the vigorous stirring typically employed during the preparation of tabular grain emulsions. In general category S-III surfactants having molecular weights of less than about 60,000, preferably less than about 40,000, are contemplated for use, category S-IV surfactants having molecular weight of less than 50,000, preferably less than about 30,000, are contemplated for use.

While commercial surfactant manufacturers have in the overwhelming majority of products selected 1,2-propylene oxide and ethylene oxide repeating units for forming lipophilic and hydrophilic block units of nonionic block copolymer surfactants on a cost basis, it is recognized that other alkylene oxide repeating units can, if desired, be substituted in any of the category S-I, S-II, S-III and S-IV surfactants, provided the intended lipophilic and hydrophilic properties are retained. For example, the propylene oxide repeating unit is only one of a family of repeating units that can be illustrated by formula XIV

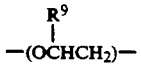

(XIV)

where $R^9$ is a lipophilic group, such as a hydrocarbon—e.g., alkyl of from 1 to 10 carbon atoms or aryl of from 6 to 10 carbon atoms, such as phenyl or naphthyl.

In the same manner, the ethylene oxide repeating unit is only one of a family of repeating units that can be illustrated by formula XV:

$$-(OCH\overset{R^{10}}{\overset{|}{C}}H_2)- \quad (XV)$$

where $R^{10}$ is hydrogen or a hydrophilic group, such as a hydrocarbon group of the type forming $R^9$ above additionally having one or more polar substituents—e.g., one, two, three or more hydroxy and/or carboxy groups.

In each of the surfactant categories each of block units contain a single alkylene oxide repeating unit selected to impart the desired hydrophilic or lipophilic quality to the block unit in which it is contained. Hydrophilic-lipophilic balances (HLB's) of commercially available surfactants are generally available and can be consulted in selecting suitable surfactants.

Only very low levels of surfactant are required in the emulsion at the time parallel twin planes are being introduced in the grain nuclei to reduce the grain dispersity of the emulsion being formed. Surfactant weight concentrations are contemplated as low as 0.1 percent, based on the interim weight of silver—that is, the weight of silver present in the emulsion while twin planes are being introduced in the grain nuclei. A preferred minimum surfactant concentration is 1 percent, based on the interim weight of silver. A broad range of surfactant concentrations have been observed to be effective. No further advantage has been realized for increasing surfactant weight concentrations above 100 percent of the interim weight of silver using category S-I surfactants or above 50 percent of the interim weight of silver using category S-II, S-III or S-IV surfactants. However surfactant concentrations of 200 percent of the interim weight of silver or more are considered feasible using category S-I surfactants or 100 percent or more using category S-II, S-III or S-IV surfactants.

The preparation process is compatible with either of the two most common techniques for introducing parallel twin planes into grain nuclei. The preferred and most common of these techniques is to form the grain nuclei population that will be ultimately grown into tabular grains while concurrently introducing parallel twin planes in the same precipitation step. In other words, grain nucleation occurs under conditions that are conducive to twinning. The second approach is to form a stable grain nuclei population and then adjust the pAg of the interim emulsion to a level conducive to twinning.

Regardless of which approach is employed, it is advantageous to introduce the twin planes in the grain nuclei at an early stage of precipitation. It is contemplated to obtain a grain nuclei population containing parallel twin planes using less than 2 percent of the total silver used to form the tabular grain emulsion. It is usually convenient to use at least 0.05 percent of the total silver to form the parallel twin plane containing grain nuclei population, although this can be accomplished using even less of the total silver. The longer introduction of parallel twin planes is delayed after forming a stable grain nuclei population the greater is the tendency toward increased grain dispersity.

At the stage of introducing parallel twin planes in the grain nuclei, either during initial formation of the grain nuclei or immediately thereafter, the lowest attainable levels of grain dispersity in the completed emulsion are achieved by control of the dispersing medium.

The pAg of the dispersing medium is preferably maintained in the range of from 5.4 to 10.3 and, for achieving a COV of less than 10 percent, optimally in the range of from 7.0 to 10.0. At a pAg of greater than 10.3 a tendency toward increased tabular grain ECD and thickness dispersities is observed. Any convenient conventional technique for monitoring and regulating pAg can be employed.

Reductions in grain dispersities have also been observed as a function of the pH of the dispersing medium. Both the incidence of nontabular grains and the thickness dispersities of the nontabular grain population have been observed to decrease when the pH of the dispersing medium is less than 6.0 at the time parallel twin planes are being introduced into the grain nuclei. The pH of the dispersing medium can be regulated in any convenient conventional manner. A strong mineral acid, such as nitric acid, can be used for this purpose.

Grain nucleation and growth occurs in a dispersing medium comprised of water, dissolved salts and a conventional peptizer. Hydrophilic colloid peptizers such as gelatin and gelatin derivatives are specifically contemplated. Peptizer concentrations of from 20 to 800 (optimally 40 to 600) grams per mole of silver introduced during the nucleation step have been observed to produce emulsions of the lowest grain dispersity levels.

The formation of grain nuclei containing parallel twin planes is undertaken at conventional precipitation temperatures for photographic emulsions, with temperatures in the range of from 20° to 80° C. being particularly preferred and temperature of from 20° to 60° C. being optimum.

Once a population of grain nuclei containing parallel twin planes has been established as described above, the next step is to reduce the dispersity of the grain nuclei population by ripening. The objective of ripening grain nuclei containing parallel twin planes to reduce dispersity is disclosed by both Himmelwright U.S. Pat. No. 4,477,565 and Nottorf U.S. Pat. No. 4,722,886, the disclosures of which are here incorporated by reference. Ammonia and thioethers in concentrations of from about 0.01 to 0.1N constitute preferred ripening agent selections.

Instead of introducing a silver halide solvent to induce ripening it is possible to accomplish the ripening step by adjusting pH to a high level—e.g., greater than 9.0. A ripening process of this type is disclosed by Buntaine and Brady U.S. Pat. No. 5,013,641, issued May 7, 1991. In this process the post nucleation ripening step is performed by adjusting the pH of the dispersing medium to greater than 9.0 by the use of a base, such as an alkali hydroxide (e.g., lithium, sodium or potassium hydroxide) followed by digestion for a short period (typically 3 to 7 minutes). At the end of the ripening step the emulsion is again returned to the acidic pH ranges conventionally chosen for silver halide precipitation (e.g. less than 6.0) by introducing a conventional acidifying agent, such as a mineral acid (e.g., nitric acid).

Some reduction in dispersity will occur no matter how abbreviated the period of ripening. It is preferred to continue ripening until at least about 20 percent of the total silver has been solubilized and redeposited on the remaining grain nuclei. The longer ripening is extended the fewer will be the number of surviving nuclei. This means that progressively less additional silver halide precipitation is required to produce tabular grains of an aim ECD in a subsequent growth step. Looked at another way, extending ripening decreases the size of the emulsion make in terms of total grams of silver precipitated. Optimum ripening will vary as a function of aim emulsion requirements and can be adjusted as desired.

Once nucleation and ripening have been completed, further growth of the emulsions can be undertaken in any conventional manner consistent with achieving desired final mean grain thicknesses and ECDs. The halides introduced during grain growth can be selected independently of the halide selections for nucleation. The tabular grain emulsion can contain grains of either uniform or nonuniform silver halide composition.

In optimizing the process of preparation for minimum tabular grain dispersity levels it has been observed that optimizations differ as a function of iodide incorporation in the grains as well as the choices of surfactants and/or peptizers.

While any conventional hydrophilic colloid peptizer can be employed, it is preferred to employ gelatino-peptizers during precipitation. Gelatino-peptizers are commonly divided into so-called "regular" gelatino-peptizers and so-called "oxidized" gelatino-peptizers. Regular gelatino-peptizers are those that contain naturally occurring amounts of methionine of at least 30 micromoles of methionine per gram and usually considerably higher concentrations. The term oxidized gelatino-peptizer refers to gelatino-peptizers that contain less than 30 micromoles of methionine per gram. A regular gelatino-peptizer is converted to an oxidized gelatino-peptizer when treated with a strong oxidizing agent, such as taught by Maskasky U.S. Pat. No. 4,713,323 and King et al U.S. Pat. No. 4,942,120, the disclosures of which are here incorporated by reference. The oxidizing agent attacks the divalent sulfur atom of the methionine moiety, converting it to a tetravalent or, preferably, hexavalent form. While methionine concentrations of less than 30 micromoles per gram have been found to provide oxidized gelatino-peptizer performance characteristics, it is preferred to reduce methionine concentrations to less than 12 micromoles per gram. Any efficient oxidation will generally reduce methionine to less than detectable levels. Since gelatin in rare instances naturally contains low levels of methionine, it is recognized that the terms "regular" and "oxidized" are used for convenience of expression while the true distinguishing feature is methionine level rather than whether or not an oxidation step has been performed.

When an oxidized gelatino-peptizer is employed, it is preferred to maintain a pH during twin plane formation of less than 5.2 to achieve a minimum (less than 10 percent) COV. When a regular gelatino-peptizer is employed, the pH during twin plane formation is maintained at less than 3.0 to achieve a minimum COV.

When regular gelatin and a category S-I surfactant are each employed prior to post-ripening grain growth, the category S-I surfactant is selected so that the hydrophilic block (e.g., HAO1) accounts for 4 to 96 (preferably 5 to 85 and optimally 10 to 80) percent of the total surfactant molecular weight. It is preferred that x and x' (in formula II) be at least 6 and that the minimum molecular weight of the surfactant be at least 760 and optimally at least 1000, with maximum molecular weights ranging up to 16,000, but preferably being less than 10,000.

When the category S-I surfactant is replaced by a category S-II surfactant, the latter is selected so that the lipophilic block (e.g., LAO2) accounts for 4 to 96 (preferably 15 to 95 and optimally 20 to 90) percent of the total surfactant molecular weight. It is preferred that x (formula IV) be at least 13 and that the minimum molecular weight of the surfactant be at least 800 and optimally at least 1000, with maximum molecular weights ranging up to 30,000, but preferably being less than 20,000.

When a category S-III surfactant is selected for this step, it is selected so that the lipophilic alkylene oxide block linking unit (LOL) accounts for 4 to 96 percent, preferably 15 to 95 percent, and optimally 20 to 90 percent of the total surfactant molecular weight. In the ethylene oxide and 1,2-propylene oxide forms shown in formula (XIIIa), x can range from 3 to 250 and y can range from 2 to 340 and the minimum molecular weight of the surfactant is greater than 1,100 and optimally at least 2,000, with maximum molecular weights ranging up to 60,000, but preferably being less than 40,000. The concentration levels of surfactant are preferably restricted as iodide levels are increased.

When a category S-IV surfactant is selected for this step, it is selected so that the hydrophilic alkalylene oxide block linking unit (HOL) accounts for 4 to 96 percent, preferably 5 to 85 percent, and optimally 10 to 80 percent of the total surfactant molecular weight. In the ethylene oxide and 1,2-propylene oxide forms shown in formula (XIIIb), x can range from 3 to 250 and y can range from 2 to 340 and the minimum molecular weight of surfactant is greater than 1,100 and optimally at least 2,000, with maximum molecular weights ranging up to 50,000, but preferably being less than 30,000.

When oxidized gelatino-peptizer is employed prior to post-ripening grain growth and no iodide is added during post-ripening grain growth, minimum COV emulsions can be prepared with category S-I surfactants chosen so that the hydrophilic block (e.g., HAO1) accounts for 4 to 35 (optimally 10 to 30) percent of the total surfactant molecular weight. The minimum molecular weight of the surfactant continues to be determined by the minimum values of x and x' (formula II) of 6. In optimized forms x and x' (formula II) are at least 7. Minimum COV emulsions can be prepared with category S-II surfactants chosen so that the lipophilic block (e.g., LAO2) accounts for 40 to 96 (optimally 60 to 90) percent of the total surfactant molecular weight. The minimum molecular weight of the surfactant continues to be determined by the minimum value of x (formula IV) of 13. The same molecular weight ranges for both category S-I and S-II surfactants are applicable as in using regular gelatino-peptizer as described above.

The polyalkylene oxide block copolymer surfactant can, if desired, be removed from the emulsion after it has been fully prepared. Any convenient conventional washing procedure, such as those illustrated by *Research Disclosure,* Vol. 308, December 1989, Item 308,119, Section II, can be employed. The polyalkylene oxide block copolymer surfactant constitutes a detectable component of the final emulsion when present in concentrations greater than 0.02 percent, based on the total weight of silver.

Apart from the features described above the reversal dye image forming photographic elements of the invention can be constructed using conventional features, such as those set out in Kofron et al U.S. Pat. No. 4,439,520 and Sowinski et al, each cited above, and here incorporated by reference, each of which suggest emulsion blending. Grain populations, such as those of Lippmann emulsions, that do not contribute to light capture during imagewise exposure are not included within and can be present in addition to the grain populations described above. In addition, features compatible with the construction of reversal dye image forming photographic elements disclosed by *Research Disclosure,* Item 308,119, cited above, and here incorporated by reference, can be employed. Referring to Item 308,119, the emulsions can be washed (Section II), chemically sensitized (Section III). spectrally sensitized (Section IV, but excluding paragraphs G and L), protected by the inclusion of one or more antifoggants and sensitizers (Section VI), and hardeners (Section X). Each of the dye image forming layer units can contain in an emulsion layer or in an adjacent layer one or more couplers, including both couplers that release or form dyes as well as that release other photographically useful groups, such as those set forth in Section VII. The emulsion and other layers of the photographic elements can include coating aids (Section XI), plasticizers and lubricants (Section XII), antistatic layers (Section XIII), and matting agents (Section XVI). Any conventional transparent film support, such as any transparent film support of the various constructions described in Section XVII can be employed. Conventional coating and drying procedures can be employed in forming the emulsion and optional additional layers, such as subbing and overcoat layers, can be employed as described in Section XV. Conventional exposure and processing. illustrated by Sections XVIII and XIX(D), respectively, are contemplated. As is generally well recognized by those skilled in the art, dye forming or releasing couplers can either be incorporated in the photographic elements or incorporated in the photographics during processing.

A specifically preferred reversal dye image forming photographic element construction is as follows:

| |
|---|
| Overcoat Layer |
| Blue Recording Layer Unit |
| Yellow Filter Layer |
| Green Recording Layer Unit |
| Interlayer |
| Red Recording Layer Unit |
| Subbing Layer |
| Photographic Support |

In the foregoing construction the Photographic Support is preferably a transparent cellulose ester, such as cellulose acetate, or a transparent polyester, such as poly(ethylene terephthalate). The Subbing Layer is preferably a natural or modified gelatin layer. Each of the Blue, Green and Red Recording Layer Units consists of two or three emulsion layers, each containing the fastest emulsion layer farthest from the support and the slowest emulsion layer nearest the support. The Interlayer contains an oxidized developing agent scavenger in a natural or modified gelatin layer. The Yellow Filter Layer preferably contains Carey Lea silver or a processing solution removable dye and an oxidized developing agent scavenger in a natural or modified gelatin layer. The Overcoat Layer contains natural or modified gelatin as well as a matting agent, a surfactant and an antistatic agent.

EXAMPLES

Coating coverages parenthetically included in the examples are in units of mg/dm$^2$.

EXAMPLE 1 (AKT-615)

The purpose of this example is to demonstrate a silver bromoiodide emulsion in which tabular grains account for greater than 97 percent of the total projected area of grains having an ECD (equivalent circular diameter) of at least 0.2 μm and which was prepared with iodide run in during post-ripening growth step.

In a 4-liter reaction vessel was placed an aqueous gelatin solution (composed of 1 liter of water, 1.3 g of alkali-processed gelatin, 4.2 ml of 4N nitric acid solution, 2.44 g of sodium bromide and having pAg of 9.71, and 2.76%, based on the total weight of silver introduced, of PLURONIC TM -17R1, a surfactant satisfying formula II, x=15, x'=15, y=4) and while keeping the temperature thereof at 45° C., 13.3 ml of an aqueous solution of silver nitrate (containing 1.13 g of silver nitrate) and equal amount of an aqueous solution of sodium bromide (containing 0.69 g of sodium bromide) were simultaneously added thereto over a period of 1 minute at a constant rate. Then, into the mixture was added 14.2 ml of an aqueous sodium bromide solution (containing 1.46 g of sodium bromide) after 1 minute of mixing. Temperature of the mixture was raised to 60° C. over a period of 9 minutes. At that time, 33.5 ml of an aqueous ammoniacal solution (containing 1.68 g of ammonium sulfate and 16.8 ml of 2.5N sodium hydroxide solution) was added into the vessel and mixing was conducted for a period of 9 minutes. Then, 88.8 ml of an aqueous gelatin solution (containing 16.7 g of alkali-processed gelatin and 5.5 ml of 4N nitric acid solution) was added to the mixture over a period of 2 minutes. After then, 83.3 ml of an aqueous silver nitrate solution (containing 22.64 g of silver nitrate) and 78.7 ml of an aqueous halide solution (containing 12.5 g of sodium bromide and 2.7 g of potassium iodide) were added at a constant rate for a period of 40 minutes. Then, 299 ml of an aqueous silver nitrate solution (containing 81.3 g of silver nitrate) and 284.1 ml of an aqueous halide solution (containing 45 g of sodium bromide and 9.9 g of potassium iodide) were simultaneously added to the aforesaid mixture at constant ramp starting from respective rate of 2.08 ml/min and 2.05 ml/min for the subsequent 35 minutes. Then, 349 ml of an aqueous silver nitrate solution (containing 94.9 g of silver nitrate) and 330 ml of an aqueous halide solution (containing 52.3 g of sodium bromide and 11.5 g of potassium iodide) were simultaneously added to the aforesaid mixture at constant rate over a period of 23.3 minutes. The silver halide emulsion thus obtained contained 12.4 mole% of iodide.

The properties of grains of this emulsion were found to be as follows:

Average Grain ECD: 1.10 μm
Average Grain Thickness: 0.211 μm
Tabular Grain Projected Area: approx. 100%
Average Aspect Ratio of the Grains: 5.2
Average Tabularity of the Grains: 24.6
Coefficient of Variation of Total Grains: 8.2%

EXAMPLE 2 (MK-92)

The purpose of this example is to demonstrate a silver bromoiodide emulsion in which tabular grains account for greater than 97 percent of the total projected area of grains having an ECD (equivalent circular diameter) of at least 0.2 μm and which was prepared by dumping iodide into the reaction vessel during the post-ripening grain growth step.

In a 4-liter reaction vessel was placed an aqueous gelatin solution having a pAg of 9.72 composed of 1 liter of water, 1.3 g of alkali-processed gelatin, 4.2 ml of 4N nitric acid solution, 2.5 g of sodium bromide, and PLURONIC TM -31R1, a surfactant which satisfies formula II, x=25, x'=25, y=7. The surfactant constituted 15.76 percent by weight of the total silver introduced up to the beginning of the post-ripening grain growth step. While keeping the temperature thereof at 40° C., 13.3 ml of an aqueous solution of silver nitrate (containing 1.13 g of silver nitrate) and equal amount of an aqueous halide solution (containing 0.69 g of sodium bromide and 0.0155 g of potassium iodide) were simultaneously added thereto over a period of 1 minute at a constant rate. Then, into the mixture was added 14.2 ml of an aqueous sodium bromide solution (containing 1.46 g of sodium bromide) after 1 minute of mixing. Temperature of the mixture was raised to 50° C. over a period of 6 minutes after 1 minute of mixing. Thereafter, 32.5 ml of an aqueous ammoniacal solution (containing 1.68 g of ammonium sulfate and 15.8 ml of 2.5N sodium hydroxide solution) was added into the vessel and mixing was conducted for a period of 9 minutes. Then, 83.3 ml of an aqueous gelatin solution (containing 25.0 g of alkali-processed gelatin and 5.5 ml of 4N nitric acid solution) were added to the mixture over a period of 2 minutes. After then, 83.3 ml of an aqueous silver nitrate solution (containing 22.64 g of silver nitrate) and 84.7 ml of an aqueous halide solution (containing 14.5 g of sodium bromide and 0.236 g of potassium iodide) were added at a constant rate for a period of 40 minutes. Then, 299 ml of an aqueous silver nitrate solution (containing 81.3 g of silver nitrate) and 298 ml of an aqueous halide solution (containing 51 g of sodium bromide and 0.831 g of potassium iodide) were simultaneously added to the aforesaid mixture at constant ramp starting from respective rate of 2.08 ml/min and 2.12 ml/min for the subsequent 35 minutes. Then, 128 ml of an aqueous silver nitrate solution (containing 34.8 g of silver nitrate) and 127 ml of an aqueous halide solution (containing 21.7 g of sodium bromide and 0.354 g of potassium iodide) were simultaneously added to the aforesaid mixture at constant rate over a period of 8.5 minutes. An iodide solution in the amount of 125 cc containing 3.9 g potassium iodide was added at rate of 41.7 cc/min for 3 minutes followed by a 2 minute hold under unvaried conditions. Thereafter, 221 ml of an aqueous silver nitrate solution (containing 60 g of silver nitrate) and equal amount of an aqueous halide solution (containing 38.2 g of sodium bromide) were simultaneously added to the aforesaid mixture at a constant rate over a period of 16.6 minutes. The silver halide emulsion thus obtained contained 2.7 mole % of iodide.

The properties of grains of this emulsion were found to be as follows:

Average Grain ECD: 0.65 μm
Average Grain Thickness: 0.269 μm
Tabular Grain Projected Area: approx. 100%
Average Aspect Ratio of the Grains: 2.4
Average Tabularity of the Grains: 9
Coefficient of Variation of Total Grains: 9.9%

EXAMPLES 3 and 4

The purpose of these examples is to demonstrate the effect of a category S-I surfactant on achieving a high tabularity, high specularity emulsion.

EXAMPLE 3 (AKT-244)

In a 4-liter reaction vessel was placed an aqueous gelatin solution (composed of 1 liter of water, 1.3 g of oxidized alkali-processed gelatin, 4.2 ml of 4 N nitric acid solution, 0.035 g of sodium bromide and having a pAg of 7.92), and the surfactant PLURONIC TM -31R1, which satisfies formula II, x=25, x'=25, y=7. The surfactant constituted of 12.28 percent by weight of the total silver introduced up to the beginning of the post-ripening grain growth step. While keeping the temperature at 45° C., 13.3 ml of an aqueous solution of silver nitrate (containing 1.13 g of silver nitrate) and a balancing molar amount of an aqueous solution of sodium bromide and sodium iodide (containing 0.677 g of sodium bromide and 0.017 g of sodium iodide) were simultaneously added thereto over a period of 1 minute at a constant rate. Then, into the mixture was added 24.2 ml of an aqueous sodium bromide solution (containing 2.49 g of sodium bromide) after 1 minute of mixing. Temperature of the mixture was raised to 60° C. over a period of 9 minutes. At that time, 33.5 ml of an aqueous ammoniacal solution (containing 1.68 g of ammonium sulfate and 16.8 ml of 2.5N sodium hydroxide solution) was added into the vessel and mixing was conducted for a period of 9 minutes. Then, 88.8 ml of an aqueous gelatin solution (containing 16.7 g of oxidized alkali-processed gelatin and 5.5 ml of 4N nitric acid solution) was added to the mixture over a period of 2 minutes. After then, 83.3 ml of an aqueous silver nitrate solution (containing 22.64 g of silver nitrate) and 81.3 ml of an aqueous sodium bromide solution (containing 14.6 g of sodium bromide) were added at a constant rate for a period of 40 minutes. Then, 299 ml of an aqueous silver nitrate solution (containing 81.3 g of silver nitrate) and 285.3 ml of an aqueous sodium bromide solution (containing 51.4 g of sodium biomide) were simultaneously added to the aforesaid mixture at constant ramp starting from respective rate of 2.08 ml/min and 2.07 ml/min for the subsequent 64 minutes. Then, 349 ml of an aqueous silver nitrate solution (containing 94.9 g of silver nitrate) and 331.9 ml of an aqueous sodium bromide solution (containing 59.8 g of sodium bromide) were simultaneously added to the aforesaid mixture at constant rate over a period of 23.3 minutes. The silver halide emulsion thus obtained was washed.

The properties of grains of this emulsion were found to be as follows:

Average Grain ECD: 1.73 μm
Average Grain Thickness: 0.093 μm
Tabular Grain Projected Area: approx. 100%
Average Aspect Ratio of the Grains: 18.6
Average Tabularity of the Grains: 200
Coefficient of Variation of Total Grains: 7.5%

EXAMPLE 4 (AKT-428)

In a 4-liter reaction vessel was placed an aqueous gelatin solution (composed of 1 liter of water, 1.3 g of alkali-processed gelatin, 3.7 ml of 4N nitric acid solution, 1.12 g of sodium bromide (pAg 9.39), and 2.92 percent (based on total silver used in nucleation) of PLURONIC TM -12R3, a surfactant satisfying formula II, x=11, x'=11, y=12). While keeping the temperature the solution at 45° C., 13.3 ml of an aqueous solution of silver nitrate (containing 1.13 g silver nitrate) and an equal amount of an aqueous solution of sodium bromide (containing 0.69 g sodium bromide) were simultaneously added thereto over a period of 1 min. at a constant rate. Thereafter, into the mixture was added 14.2 ml of an aqueous sodium bromide solution (containing 1.46 g sodium bromide) after 1 min. of mixing. The temperature of the mixture was raised to 60° C. over a period of 9 minutes, and then mixing was continued for another 9 min. period. Then, 83.3 ml of an aqueous gelatin solution (containing 16.7g of alkali-processed gelatin and 5.8 ml of 2.5N sodium hydroxide) was added to the mixture over a period of 2 min. Following that, 133.3 ml of an aqueous silver nitrate solution (containing 11.32 g silver nitrate) and 152.3 ml of an aqueous sodium bromide solution (containing 7.85 g sodium bromide) were added at a constant rate for a period of 20 min. Then, 299 ml of an aqueous silver nitrate solution (containing 81.3 g silver nitrate) and 285.3 g of an aqueous sodium bromide solution (containing 49.7 g of sodium bromide and 2.70 g of potassium iodide) were simultaneously added to the aforesaid mixture at a constant ramp starting from respective rates of 2.09 and 2.07 ml/min. for 35 mins. Then, 393 ml of aqueous silver nitrate (containing 106.8 g of silver nitrate) and 373.8 ml of aqueous sodium bromide (containing 65.2 g sodium bromide and 3.47 g potassium iodide) were simultaneously added to the mixture at constant rate over a period of 26.2 min. The silver halide emulsion thus obtained contained 3.1 mole % of iodide. It was then washed and the properties of grains of this emulsion were as follows:

Average grain size: 1.16 μm
Average grain thickness: 0.157 μm
Tabular grain projected area: 98.4%
Average aspect ratio of grains: 7.4
Average tabularity of grains: 47.1
Coefficient of variation of total grains: 23.0%

EXAMPLES 5 and 6

The purpose of these examples is to demonstrate the effect of a category S-II surfactant on achieving a high tabularity, high specularity emulsion.

EXAMPLE 5 (AKT-612)

The purpose of this example is to illustrate the preparation of a high tabularity, high specularity tabular grain emulsion employing a category S-II surfactant.

In a 4-liter reaction vessel was placed an aqueous gelatin solution (composed of 1 liter of water, 1.3 g of alkali-processed gelatin, 4.2 ml of 4N nitric acid solution, 2.44 g of sodium bromide and having a pAg of 9.71 and 1.39 wt %, based on total silver used in nucleation, of PLURONIC TM -L63, a surfactant satisfying formula IV, x=32, y=9, y'=9) and while keeping the temperature thereof at 45° C., 13.3 ml of an aqueous solution of silver nitrate (containing 1.13 g of silver nitrate) and equal amount of an aqueous solution of sodium bromide (containing 0.69 g of sodium bromide) were simultaneously added thereto over a period of 1 minute at a constant rate. Thereafter, after 1 minute of mixing, the temperature of the mixture was raised to 60° C. over a period of 9 minutes. At that time, 33.5 ml of an aqueous ammoniacal solution (containing 1.68 g of ammonium sulfate and 16.8 ml of 2.5N sodium hydroxide solution) was added into the vessel and mixing was conducted for a period of 9 minutes. Then, 88.8 ml of an aqueous gelatin solution (containing 16.7 g of alkali-processed gelatin and 5.5 ml of 4N nitric acid solution) was added to the mixture over a period of 2 minutes. After then, 83.3 ml of an aqueous silver nitrate solution (containing 2.64 g of silver nitrate) and 80 ml of an aqueous halide solution (containing 14 g of sodium bromide and 0.7 g of potassium iodide) were added at a constant rate for a period of 40 minutes. Then, 299 ml of an aqueous silver nitrate solution (containing 81.3 g of silver nitrate) and 285.3 ml of an aqueous halide solution (containing 49.8 g of sodium bromide and 2.5 g of potassium iodide) were simultaneously added to the aforesaid mixture at constant ramp starting from respective rate of 2.08 ml/min and 2.07 ml/min for the subsequent 35 minutes. Then, 349 ml of an aqueous silver nitrate solution (containing 94.9 g of silver nitrate) and 331.1 ml of an aqueous halide solution (containing 57.8 g of sodium bromide and 2.9 g of potassium iodide) were simultaneously added to the aforesaid mixture at constant rate over a period of 23.3 minutes. The silver halide emulsion thus obtained contained 3.1 mole % of iodide. The emulsion was then washed.

The properties of grains of this emulsion were found to be as follows:

Average grain ECD: 1.14 μm
Average Grain Thickness: 0.179 μm
Tabular Grain Projected Area: approx. 100%
Average Aspect Ratio of the Grains: 6.4
Average Tabularity of the Grains: 35.8
Coefficient of Variation of Total Grains: 6.0%

EXAMPLE 6 (MK-155)

In a 4-liter reaction vessel was placed an aqueous gelatin solution (composed of 1 liter of water, 1.3 g of alkali-processed gelatin, 4.2 ml of 4N nitric acid solution, 2.5 g sodium bromide and having a pAg of 9.72, and 11.58% by weight, based on total silver used in nucleation, of PLURONIC TM L-31, a surfactant satisfying formula IV, x=17, y=1, and y'=1). While keeping the temperature at 45° C., 13.3 ml of aqueous silver nitrate (containing 1.13 g silver nitrate) and an equal amount of an aqueous solution of sodium bromide (containing 0.69 g. sodium bromide were simultaneously added thereto over a period of 1 min. at a constant rate. Then, into the mixture was added 14.2 ml of aqueous sodium bromide (containing 1.46 g sodium bromide) after 1 min. of mixing. The temperature of the mixture was raised to 60° C. over a period of 9 min. Thereafter, 32.5 ml of an aqueous ammoniacal solution (containing 1.68 g ammonium sulfate and 15.8 ml of 2.5N sodium hydroxide solution) was added into the vessel and mixing was conducted for a period of 9 mins. Then 172.2 ml of an aqueous gelatin solution (containing 41.7 g of alkali-processed gelatin and 5.5 ml of 4N nitric acid solution) was added to the mixture over a period of 2 mins. Following that, 83.3 mol of aqueous silver nitrate (containing 2.64 g of silver nitrate) and 84.7 ml of an aqueous halide solution (containing 14.2 g sodium bromide and 0.71 g potassium iodide) were added at a constant rate for a period of 40 mins. Then, 299 mo of an aqueous silver nitrate solution (containing 81.3 g silver nitrate) and 298 ml of an aqueous halide solution (containing 50 g of sodium bromide and 2.5 g potassium iodide) were simultaneously added to the aforesaid mixture at a constant ramp starting from respective rates of 2.08 and 2.12 ml/min for the next 35 mins. Then 128 ml of aqueous silver nitrate (containing 34.8 g silver nitrate) and 127 ml of an aqueous halide solution (containing 21.3 g sodium bromide and 1.07 g potassium iodide) were simultaneously added to the aforesaid mixture at a constant rate over a period of 8.5 mins. Thereafter, 221 ml of aqueous silver nitrate (containing 60 g silver nitrate) and an equal amount of an aqueous halide solution (containing 37.1 g sodium bromide and 1.85 g potassium iodide) were simultaneously added to the aforesaid mixture at a constant rate over a period of 16.6 mins. The silver halide emulsion thus obtained contained 3 mole % iodide.

The properties of the grains of this emulsion were found to be as follows:

Average grain ECD: 1.73 μm
Average Grain Thickness: 0.123 μm
Tabular Grain Projected Area: 99.2%
Average Aspect Ratio of the Grains 14.1
Average Tabularity of the Grains 114
Coefficient of Variation of Total Grains: 25.4%

EXAMPLES 7 to 10

The purpose of these examples is to demonstrate the effect of category S-III and S-IV surfactants on achieving high tabularity, high specularity emulsions.

EXAMPLE 7 (MK-162)

In a 4-liter reaction vessel was placed an aqueous gelatin solution (composed of 1 liter of water, 1.3 g of alkali-processed gelatin, 4.2 ml of 4N nitric acid solution, 2.5 g of sodium bromide and having a pAg of 9.72 and 11.58% by weight, based on total silver introduced prior to the post-ripening step, of TETRONIC TM-1508, N,N,N',N'-tetrakis{$H(OCH_2CH_2)_y[OCH(CH_3)CH_2]_x$}ethylenediamine surfactant, x=26, y=136). While keeping the temperature at 45° C., 13.3 ml of aqueous silver nitrate (containing 1.13 g silver nitrate) and an equal amount of an aqueous solution of sodium bromide (containing 0.69 g. sodium bromide were and while keeping the temperature thereof at 45° C., 13.3 ml of an aqueous solution of silver nitrate (containing 1.13 g of silver nitrate) and equal amount of an aqueous solution of sodium bromide (containing 0.69 g of sodium bromide) were simultaneously added thereto over a period of 1 minute at a constant rate. Then, into the mixture was added 14 2 ml of an aqueous sodium bromide solution (containing 1.46 g of sodium bromide) after 1 minute of mixing. Temperature of the mixture was raised to 60° C. over a period of 9 minutes after 1 minute of mixing. Thereafter, 32.5 ml of an aqueous ammoniacal solution (containing 1.68 g of ammonium sulfate and 15.8 ml of 2.5N sodium hydroxide solution) was added into the vessel and mixing was conducted for a period of 9 minutes. Then, 172.2 ml of an aqueous gelatin solution (containing 41.7 g of alkali-processed gelatin and 5.5 ml of 4N nitric acid solution) was added to the mixture over a period of 2 minutes. After then, 83.3 ml of an aqueous silver nitrate solution (containing 22.64 g of silver nitrate) and 84.7 ml of an aqueous halide solution (containing 14.2 g of sodium bromide and 0.71 g of potassium iodide) were added at a constant rate for a period of 40 minutes. Then, 299 ml of an aqueous silver nitrate solution (containing 81.3 g of silver nitrate) and 298 ml of an aqueous halide solution (containing 50 g of sodium bromide and 2.5 g of potassium iodide) were simultaneously added to the aforesaid mixture at constant ramp starting from respective rate of 2.08 ml/min and 2.12 ml/min for the subsequent 35 minutes. Then, 128 ml of an aqueous silver nitrate solution (containing 34.8 g of silver nitrate) and 127 ml of an aqueous halide solution (containing 21.3 g of sodium bromide and 1.07 g of potassium iodide) were simultaneously added to the aforesaid mixture at constant rate over a period of 8.5 minutes. Thereafter, 221 ml of an aqueous silver nitrate solution (containing 60 g of silver nitrate) and equal amount of an aqueous sodium bromide solution (containing 37.1 g of sodium bromide and 1.85 g of potassium iodide) were simultaneously added to the aforesaid mixture at constant rate over a period of 16.6 minutes. The silver halide emulsion thus obtained contained 3 mole % of iodide.

The properties of grains of this emulsion were found to be as follows:

Average Grain ECD: 1.20 μm
Average Grain Thickness: 0.183 μm
Tabular Grain Projected Area: approx. 100%
Average Aspect Ratio of the Grains: 6.6
Average Tabularity of the Grains: 36.1
Coefficient of Variation of Total Grains: 9.1%.

EXAMPLE 8 (MK-179)

Example 7 was repeated, except that TETRONIC TM-150R8, N,N,N',N'-tetrakis{$H[OCH(CH_3)CH_2]_x(OCH_2CH_2)_y$}ethylenediamine, x=18, y=92, was the surfactant present in the reaction vessel prior to the introduction of silver salt. The surfactant constituted 2.32 percent by weight of the total silver introduced prior to the post-ripening grain growth step.

The properties of grains of this emulsion were found to be as follows:

Average Grain ECD: 1.11 μm
Average Grain Thickness: 0.255 μm
Tabular Grain Projected Area: approx. 100%
Average Aspect Ratio of the Grains: 4.4
Average Tabularity of the Grains: 17
Coefficient of Variation of Total Grains: 9.6%

EXAMPLE 9 (MK-193)

In a 4-liter reaction vessel was placed an aqueous gelatin solution (composed of 1 liter of water, 1.3 g of alkali-processed gelatin, 4.2 ml of 4N nitric acid solution, 2.5 g of sodium bromide and having a pAg of 9.72, and 23.2% by weight, based on total silver in the nucleation, of TETRONIC TM-1508, N,N,N',N'-tetrakis-{$H(OCH_2CH_2)y$-$[OCH(CH_3)CH_2]_x$}ethylenediamine surfactant, x=26, y=136). While keeping the temperature at 45° C., 13.3 ml of aqueous silver nitrate (containing 1.13 g silver nitrate) and an equal amount of an aqueous solution of sodium bromide (containing 0.69 g. sodium bromide) were simultaneously added thereto over a period of 1 minute at a constant rate. Then, into the mixture was added 14.2 ml of an aqueous sodium bromide solution (containing 1.46 g of sodium bromide) after 1 minute of mixing. The temperature of the mixture was raised to 60° C. over a period of 9 minutes. Thereafter, 32.5 ml of an aqueous ammoniacal solution (containing 1.68 g of ammonium sulfate and 15.8 ml of 2.5N sodium hydroxide solution) was added into the vessel and mixing was continued for 9 minutes. Then, 172.2 ml of an aqueous gelatin solution (containing 41.7 g of alkali-processed gelatin and 5.5 ml of 4N nitric acid solution) was added to the mixture over a period of 2 minutes. After then, 83.3 ml of an aqueous silver nitrate solution (containing 22.64 g of silver nitrate) and 84.7 ml of an aqueous halide solution (containing 14.5 g of sodium bromide and 0.24 g of potassium iodide) were added at a constant rate for a period of 40 minutes.

Then, 299 ml of an aqueous silver nitrate solution (containing 81.3 g of silver nitrate) and 298 ml of an aqueous halide solution (containing 51 g of sodium bromide and 0.83 g of potassium iodide) were simultaneously added to the aforesaid mixture at constant ramp starting from respective rate of 2.08 ml/min and 2.12 ml/min for the subsequent 35 minutes. Then, 128 ml of an aqueous silver nitrate solution (containing 34.8 g of silver nitrate) and 127 ml of an aqueous halide solution (containing 21.3 g of sodium bromide and 1.07 g of potassium iodide) were simultaneously added to the aforesaid mixture at constant rate over a period of 8.5 minutes. Thereafter, 221 ml of an aqueous silver nitrate solution (containing 60 g of silver nitrate) and equal amount of an aqueous sodium bromide solution (containing 37.9 g of sodium bromide and 0.62 g of potassium iodide) were simultaneously added to the aforesaid mixture at constant rate over a period of 16.6 minutes. The silver halide emulsion thus obtained contained 1 mole % of iodide.

The properties of grains of this emulsion were found to be as follows:

Average Grain ECD: 1.68 μm
Average Grain Thickness: 0.131 μm
Tabular Grain Projected Area: 99.3%
Average Aspect Ratio of the Grains: 12.8
Average Tabularity of the Grains: 98
Coefficient of Variation of Total Grains: 16.2%.

EXAMPLE 10 (MK-195)

In a 4-liter reaction vessel was placed an aqueous gelatin solution (composed of 1 liter of water, 1.3 g of alkali-processed gelatin, 4.2 ml of 4N nitric acid solution, 2.5 g of sodium bromide and having a pAg of 9.72 and 2.32 percent by weight based on the total silver introduced prior to the post-ripening grain growth step of TETRONIC TM -150R8, N,N,N',N'-tetrakis{$H[OCH(CH_3)CH_2]_x$-$(OCH_2CH_2)_y$}ethylenediamine surfactant, x=18, y=92). While keeping the temperature thereof at 45° C., 13.3 ml of an aqueous solution of silver nitrate (containing 1.13 g of silver nitrate) and equal amount of an aqueous solution of sodium bromide (containing 0.69 g of sodium bromide) were simultaneously added thereto over a period of 1 minute at a constant rate. Then, into the mixture was added 14.2 ml of an aqueous sodium bromide solution (containing 1.46 g of sodium bromide) after 1 minute of mixing. Temperature of the mixture was raised to 60° C. over a period of 9 minutes after 1 minute of mixing. Thereafter, 32.5 ml of an aqueous ammoniacal solution (containing 1.68 g of ammonium sulfate and 15.8 ml of 2.5N sodium hydroxide solution) was added into the vessel and mixing was conducted for a period of 9 minutes. Then, 172.2 ml of an aqueous gelatin solution (containing 41.7 g of alkali-processed gelatin and 5.5 ml of 4N nitric acid solution) was added to the mixture over a period of 2 minutes. After then, 83.3 ml of an aqueous silver nitrate solution (containing 22.64 g of silver nitrate) and 84.7 ml of an aqueous halide solution (containing 14.2 g of sodium bromide and 0.71 g of potassium iodide) were added at a constant rate for a period of 40 minutes. Then, 299 ml of an aqueous silver nitrate solution (containing 81.3 g of silver nitrate) and 298 ml of an aqueous halide solution (containing 50 g of sodium bromide and 2.5 g of potassium iodide) were simultaneously added to the aforesaid mixture at constant ramp starting from respective rate of 2.08 ml/min and 2.12 ml/min for the subsequent 35 minutes. Then, 128 ml of an aqueous silver nitrate solution (containing 34.8 g of silver nitrate) and 127 ml of an aqueous halide solution (containing 21.3 g of sodium bromide and 1.07 g of potassium iodide) were simultaneously added to the aforesaid mixture at constant rate over a period of 8.5 minutes. Thereafter, 221 ml of an aqueous silver nitrate solution (containing 60 g of silver nitrate) and equal amount of an aqueous halide solution (containing 37.1 g of sodium bromide and 1.85 g of potassium iodide) were simultaneously added to the aforesaid mixture at constant rate over a period of 16.6 minutes. The silver halide emulsion thus obtained contained 3 mole % of iodide.

The properties of grains of this emulsion were found to be as follows:

Average Grain ECD: 1.46 μm
Average Grain Thickness: 0.134 μm
Tabular Grain Projected Area: 99.3%
Average Aspect Ratio of the Grains: 10.9
Average Tabularity of the Grains: 81
Coefficient of Variation of Total Grains: 16.2

EXAMPLES 11 and 12

The purpose of these examples is to provide a photographic comparison of an emulsion satisfying the requirements of the invention with a comparable emulsion of the type found in the art.

EXAMPLE 11 (MK202)

Example 9 of Saitou et al U.S. Pat. No. 4,797,354 was repeated, except that 3 percent iodide based on the total moles of silver was added to the emulsion at 70% of the precipitation. At 70% of the precipitation the morphology and COV are well established so that the addition of iodide did not change the COV.

In a 4-liter reaction vessel was placed an aqueous gelatin solution (having pBr of 1.42 and composed of 1 liter of water, 7 g of deionized alkali-processed gelatin, 4.5 g of potassium bromide, and 1.2 ml of 1N potassium hydroxide solution) while keeping the temperature of the solution at 30° C. Twenty-five ml of an aqueous solution of silver nitrate (containing 8.0 g of silver nitrate) and 25 ml of an aqueous solution of potassium bromide (containing 5.8 g of potassium bromide) were simultaneously added to the reaction vessel over a period of 1 minute at a rate of 25 ml/min. Then, an aqueous gelatin solution (composed of 1950 ml of water, 90 g of deionized alkali-processed gelatin, 15.3 ml of 1N aqueous potassium hydroxide solution, and 3.6 g of potassium bromide) was further added to the reaction vessel, and the temperature of the mixture was raised to 75° C. over a period of 10 minutes. Thereafter, ripening was performed for 50 minutes.

The mixture was then transferred to a 12-liter vessel, into which, 200 ml of an aqueous silver nitrate solution (containing 90 g of silver nitrate) were added at a rate of 20 ml/min. Twenty-five seconds after commencing the addition of the silver nitrate the 12-liter vessel, 191.6 ml of an aqueous potassium bromide solution (containing 61.2 g of potassium bromide) were added to the 12-liter vessel at a rate of 20 ml/min., the additions of both solutions being finished at the same time. Thereafter, the resultant mixture was stirred for 2 minutes, then 1336 ml of an aqueous silver nitrate solution (containing 601.9 g of silver nitrate) and 1336 ml of a potassium bromide solution (containing 425.4 g of potassium bromide) were simultaneously added to the aforesaid mixture at a rate of 40 ml/min for the first 20 minutes and 60 ml/min for the subsequent 8.9 minutes.

An iodide solution in the amount of 750 ml containing 29.23 g potassium iodide was added at a rate of 250 ml/min for 3 minutes followed by a 2 minute hold under unvaried conditions. Subsequently 664 ml of an aqueous silver nitrate solution (containing 299.1 g of silver nitrate) and an equal volume of a potassium bromide solution (containing 211.4 g potassium bromide) were simultaneously added at a rate of 40 ml/min for 16.6 minutes. Then, after stirring the mixture for 1 minute, the silver halide emulsion thus obtained was washed and redispersed.

The properties of grains oi this emulsion were as follows:

Average Grain ECD: 1.18 μm
Average Grain Thickness: 0.187 μm
Total Grain Projected Area: <97%
Average Aspect Ratio: 6.31
Average Tabularity: 33.7
Coefficient of Variation of Total Grains: 32.6%

When the coefficient of variation of only the hexagonal tabular grains was measured, it was approximately 13%.

EXAMPLE 12 (MK219)

In a 4-liter reaction vessel were placed an aqueous gelatin solution (having a pAg of 9.39 and composed of 1 liter of water, 0.83 g of oxidized alkali-processed gelatin, 4.0 ml of 4N nitric acid solution, and 1.12 g of sodium bromide) and 14.76 wt %, based on total silver introduced up to the beginning of post-ripening grain growth stage, of PLURONIC TM -31R1 (which satisfies formula II with x=25, y=7 and x'=25). While keeping the temperature of the reaction vessel at 45° C., 5.3 ml of an aqueous solution of silver nitrate (containing 0.725 g of silver nitrate) and an equal volume of an aqueous solution of sodium bromide (containing 0.461 g of sodium bromide) were simultaneously added over a period of 1 minute at a constant rate. Then, into the mixture were added 14.2 ml of an aqueous sodium bromide solution (containing 1.46 g of sodium bromide) after 1 minute of mixing. The temperature of the mixture was raised to 60° C. over a period of 9 minutes. At that time, 65 ml of an aqueous ammoniacal solution (containing 3.36 g of ammonium sulfate and 26.7 ml of 2.5 N sodium hydroxide solution) were added into the vessel, and mixing was conducted for a period of 9 minutes. Then, 83.3 ml of an aqueous gelatin solution (containing 16.7 g of oxidized alkali-processed gelatin and 11.4 ml of 4N nitric acid solution was added to the mixture over a period of 2 minutes. Thereafter, 83.3 ml of an aqueous silver nitrate solution (containing 22.67 g of silver nitrate) and 81.3 ml of an aqueous sodium bromide solution (containing 14.6 g of sodium bromide) were added at a constant rate for a period of 40 minutes. Then 299 ml of an aqueous silver nitrate solution (containing 81.3 g of silver nitrate) and 285.8 ml of an aqueous sodium bromide solution (containing 51.5 g of sodium bromide) were simultaneously added to the aforesaid mixture at constant ramp starting from respective rate of 2.08 ml/min and 2.12 ml/min for the subsequent 35 minutes. Then, 16.3 ml of an aqueous silver nitrate solution (containing 4.43 g of silver nitrate) and 15.6 ml of an aqueous sodium bromide solution (containing 2.81 g of sodium bromide) were simultaneously added to the aforesaid mixture at constant rate over 1.08 minutes. An iodide solution in the amount of 125 ml containing 4.87 g potassium iodide was added at a rate of 41.7 ml/min for 3 minutes followed by a 2 minute hold under unvaried conditions. Subsequently, 172.2 ml of an aqueous silver nitrate solution (containing 46.8 g of silver nitrate) and an equal volume of an aqueous sodium bromide solution (containing 31.0 g of sodium bromide) were simultaneously added to the aforesaid mixture at constant rate over a period of 20.7 minutes. The silver halide emulsion thus obtained was washed and redispersed.

The properties of grains of this emulsion were as follows:

Average Grain ECD: 1.2 μm
Average Grain Thickness: 0.194 μm
Total Grain Projected Area: >97%
Average Aspect Ratio of the Grains: 6.2
Average Tabularity of the Grains: 31.8
Coefficient of Variation of Total Grains: 4.5%

SENSITIZATION

Each of the emulsions of Examples 11 and 12 were optimally sensitized. Although the ECD, thickness and iodide placement of the tabular grains were essentially similar, the sensitizations that produced optimum, photographic response for the emulsions differed, reflecting differences in grain size distributions.

The emulsion of Example 11 exhibited optimum photographic performance with the following sensitization: 0.95 millimole of Dye A (5,5'-dichloro-3,3'-di(3-sulfopropyl)thiacyanine, sodium salt) per mole silver, 1.8 mg of sodium aurous(I)dithiosulfate dihydrate per mole silver, 0.9 mg sodium thiosulfate pentahydrate per mole silver, and 40 mg of 3-(2-methylsulfamoylethyl)-benzothiazolium tetrafluoroborate per mole silver. The emulsion and sensitizers were heated to 65° C. and held for 15 minutes to complete sensitization.

The emulsion of Example 12 exhibited optimum photographic performance with the following sensitization: 0.90 millimole Dye A, 2.7 mg sodium aurous(I) dithiosulfate dihydrate, 1.35 mg sodium thiosulfate pentahydrate and 40 mg 3-(2-methylsulfamoylethyl)benzothiazolium tetrafluoroborate per mole silver, the emulsion being heated to 65° C. and held for 15 minutes to complete sensitization.

COATING AND PROCESSING

The sensitized emulsions were each coated onto a clear cellulose acetate film support. Each emulsion layer contained on a per square decimeter basis 3.77 silver, 9.68 mg Coupler Y-1,

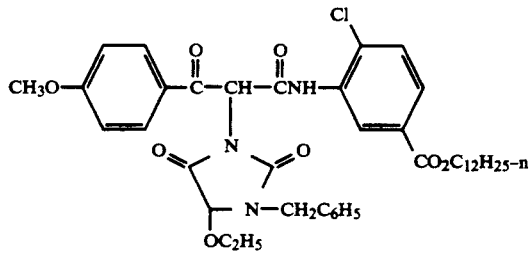

16.14 mg gelatin, and 0.061 mg 1,2,4-triazaindolizine was coated. A gel overcoat of 21.52 mg gelatin per square decimeter and bis(vinylsulfonylmethyl) ether gelatin hardener was coated above the emulsion layer.

The coated samples were exposed through a step tablet, a Wratten 2B TM filter and a 1.0 neutral density filter to a 5500° K light source for 1/50th second and then processed in the Kodak Ektachrome TM E6 process described in the *British Journal of Photography*, 1977, 194–197.

Sensitometric results are summarized below in Table I.

TABLE I

| Ex. | COV | Dmax | Speed (log E) | Contrast | Grain | TGPA* |
|---|---|---|---|---|---|---|
| 11 | 32.6% | 1.02 | 0 | 1.00 | 0 | <97% |
| 12 | 4.5% | 1.10 | −0.15 | 1.41 | −9GU | >97% |

*Tabular grain projected area.

The low COV emulsion of Example 12 having a tabular grain projected area of >97%, thereby satisfying the requirements of the invention, exhibited a higher maximum density and a higher contrast than the control emulsion of Example 11, which is representative of the lowest conventional COV's in tabular grain emulsions having a projected area of <97%. Grain unit comparisons, showing a distinct advantage for the emulsion of Example 12, were based on comparisons of the lowest contrast normalized granularities (granularity divided by contrast). Fog comparisons, not included in Table I, showed the Example 12 emulsion to have a lower fog than the Example 10 control emulsion. While the emulsion of the invention was slightly slower than the control emulsion, this deficiency is readily rectified simply by increasing the ECD of the emulsion during precipitation. It is generally accepted that a one stop (0.30 log E) increase in speed results in an increase in granularity of 7 grain units. Thus, it is apparent that the emulsion of the invention exhibits a significant granularity advantage over the control emulsion, equivalent to a speed advantage of 0.24 log E.

EXAMPLES 13 AND 14

The purpose of these example is to corroborate the advantages of the invention demonstrated above utilizing invention and control emulsions of varied structure.

EXAMPLE 13 (SHK1628)

A "run-dump" silver bromoiodide was prepared as described by Example 2, but the following variations: The temperatures of grain nucleation and growth were 45° C. and 60° C., respectively, with the temperature increase occurring over a period of 9 minutes. Only 75 percent of the surfactant was added to the kettle before nucleation. The rest of the surfactant was added to the aqueous gelatin solution added prior to the grain growth step. The aqueous gelatin solution was diluted with 161 ml more water and contained deionized gelatin. The nucleation salt solution contained 30 percent less potassium iodide. The amount of ammonium sulfate used was 48 percent less, and instead of using potassium iodide solution, 0.0238 mole of a preformed silver iodide emulsion (approx. 0.05 μm ECD) was added after the growth period.

The emulsion contained 2.7 mole percent iodide based on silver, and the properties of grains of this emulsion were as follows:

Average Grain ECD: 1.12 μm
Average Grain Thickness: 0.201 μm
Tabular grain projected area: >97%
Average Aspect Ratio of the Grains: 5.6
Average Tabularity of the Grains: 27.7
Coefficient of Variation of Total Grains: 9%

The emulsion of Example 13 exhibited optimum photographic performance with the following sensitization: 100 mg of sodium thiocyanate, 1.15 millimole Dye B (anhydro-5'-chloro-3,3'-bis(3-sulfopropyl)naphtho[1,2-d]oxazolothiacyanine hydroxide triethylamine), 2.5 mg sodium aurous(I) dithiosulfate dihydrate, 1.25 mg sodium thiosulfate pentahydrate, and 24.2 mg 3-(2-methylsulfamoylethyl)benzothiazolium tetrafluoroborate per mole silver with the emulsion being heated to 75° C. and held at this temperature for 15 minutes to complete sensitization. Because this emulsion contained fewer fine and nontabular grains, it required smaller amounts of sensitizers for optimum sensitization.

EXAMPLE 14

A conventional "run-dump" silver bromoiodide emulsion containing 3 mole percent iodide was employed as a control.

The properties of grains of this emulsion were as follows:

Average Grain ECD: 1.95 μm
Average Grain Thickness: 0.097 μm
Tabular Grain Projected Area: <97%
Average Aspect Ratio of the Grains: 20.1
Average Tabularity of the Grains: 207
Coefficient of Variation of Total Grains: 31%

The emulsion of Example 14 exhibited optimum photographic performance with the following sensitization: 150 mg sodium thiocyanate, 1.60 millimole Dye B, 2.8 mg sodium aurous(I) dithiosulfate dihydrate, 2.18 mg sodium thiosulfate pentahydrate, 10 mg 3-methylbenzothiazolium iodide, and 251 mg potassium chloride per mole silver with the emulsion being heated to 70° C. and held at this temperature for 10 minutes to complete sensitization.

COATING AND PROCESSING

The sensitized emulsions were each coated onto a clear cellulose acetate film support. Each emulsion layer contained on a per square decimeter basis 8.07 mg silver. The emulsion layers additionally contained 14.2 mg Coupler Y-1, 23.7 mg gelatin, and 0.131 mg 4-hydroxy-6-methyl-1,3,3a,7-tetraazaindene per square decimeter. A gelatin overcoat of 23.7 mg/dm$^2$ with bis(vinylsulfonylmethyl) ether as hardener was coated over the emulsion layer. The coated samples were exposed through a step tablet as described in connection with Examples 9 and 10 and then processed in the Kodak Ektachrome TM E6 process described in the *British Journal of Photography;l* 1977, 194–197.

Sensitometric results are summarized below in Table II.

TABLE II

| Ex. | COV | Dmax | Speed (log E) | Contrast | Grain | TGPA |
|---|---|---|---|---|---|---|
| 13 | 9% | 2.38 | −0.10 | 1.07 | −5GU | >97% |
| 14 | 31% | 2.40 | 0 | 1.00 | 0 | <97% |

By comparison of the data of Tables I and II it is apparent that the advantages discussed above in connection Table I are generally corroborated with the varied emulsions compared in Table II, with the speed-granularity advantage of the photographic element prepared using the Example 11 emulsion being about one third stop.

EXAMPLE 15

In the description of the emulsions above nucleation is undertaken in the presence of a polyalkylene oxide block copolymer surfactant with silver halide solvents, such as thiocyanate, thioether or ammonia, optionally being introduced toreduce grain nuclei dispersity before undertaking grain growth. This example has as its purpose to demonstrate the compatibility of a silver halide solvent with the surfactant during grain nucleation while still achieving high tabularity, high specularity tabular grain emulsions.

To a vessel containing 6 L of water were added 4 g of a low methionine deionized gelatin, 0.25 g of 3,6-dithia-1,8-octanediol, 7.116 g of PLURONIC TM L-43, (a surfactant satisfying formula IV, x=19, y=6, y'=6), sufficient acid to adjust the pH to 3.5, sufficient sodium bromide solution to adjust the pAg to 9.6. To this mixture at a temperature of 40° C. were simultaneously added a solution of silver nitrate (0.9 mole/L) and a 4 mole percent iodide sodium bromide solution over a period of 15 seconds, such that 0.072 mole of silver bromoiodide was nucleated.

After nucleation the emulsion was held at 40° C. for 15 minutes. At this point, 122 g of low methionine deionized gelatin was added, the pH adjusted to 4.5 and double-jet precipitation resumed using 2.5 moles per liter of silver nitrate and the same halide salt solution as above while maintaining a pAg of 9.5, precipitation being continued until 7 moles of total silver bromoiodide had been precipitated.

The thus obtained tabular silver bromoiodide grains had the following physical characteristics:
Average Grain ECD: 0.4523 μm,
Average Grain Thickness: 0.070 μm,
Tabular grain projected area: >97%
Average Aspect Ratio: 6.46,
Average Tabularity of the Grains: 92.3, and
Coefficient of Variation of Total Grains: 13%

EXAMPLE 16

Two multilayer color reversal elements are compared showing an improvement in sharpness when which the element of the invention (CR-2) contains in its slow yellow layer a tabular grain emulsion in which the tabular grains account for greater than 97% of the total projected area of grains having an equivalent circular diameter of at least 0.2 μm. The control element (CR-1) has in its slow yellow layer a corresponding emulsion in which the tabular grains account for less than 97%.

In the control emulsion (CR-1) the following layers were coated on a cellulose ester film support:

1) Antihalation layer: Gelatin (2411) containing gray silver (339);
2) Interlayer: Gelatin (1227);
3) Slow cyan emulsion layer: Gelatin (861), red-sensitive silver bromoiodide (4.0% I) emulsion (592 Ag), a silver bromide Lippman emulsion (65 Ag), a dispersion of cyan dye-forming coupler C (194) in dibutyl phthalate (97), and arylhydrazide competitor H (54);
4) Fast cyan emulsion layer: Gelatin (1507), red-sensitive silver bromoiodide (4.0% I) emulsion (484 Ag), fine grain silver bromoiodide (4.8% I) emulsion (54), and a dispersion of cyan dye-forming coupler C (861) in dibutyl phthalate (431);
5) Interlayer: Interlayer: Gelatin (614), arylhydrazide oxidized developer scavenger H (162), and green-absorbing dye 1,3-bis[1-{4-carboxyphenyl}-3-methyl 2-pyrazolin-5-one (4)]trimethineoxonol (65);
6) Interlayer: Gelatin (614);
7) Slow magenta emulsion layer: Gelatin (861), green-sensitive silver bromoiodide (4.0% I) emulsion (431 Ag), and a dispersion of magenta dye-forming couplers M-1 (150) and M-2 (65) in tricresyl phosphate (108);
8) Fast magenta emulsion layer: Gelatin (1507), green-sensitive silver bromoiodide (4.0% I) emulsion (431 Ag), a silver bromide Lippman emulsion (65 Ag), fine grain silver bromoiodide (4.8% I) emulsion (54), and a dispersion of magenta dye-forming couplers M-1 (565) and M-2 (242) in tricresyl phosphate (404);
9) Interlayer: Gelatin (614);
10) Interlayer: Gelatin (614), arylhydrazide oxidized developer scavenger H (108), and blue absorber 4-(4-(butanesulfonamidophenyl)-3-cyano-5-furfurylidene-2,5-dihydro-2-furanone (269);
11) Slow yellow emulsion layer: Gelatin (861) and a blue-sensitive, tabular grain silver bromoiodide (3.0 mole-% I) emulsion (431 Ag) as described in detail below, the layer also contained a dispersion of yellow dye-forming coupler Y-2 (183) in dibutyl phthalate (61) and arylhydrazide competitor H (54);
12) Fast yellow emulsion layer: Gelatin (2368), blue-sensitive silver bromoiodide (3.0% I) emulsion (538 Ag), a silver bromide Lippman emulsion (65 Ag), fine grain silver bromoiodide (4.8% I) emulsion (54), and a dispersion of yellow dye-forming coupler Y-2 (1561) in dibutyl phthalate (520);
13) Protective layer: Gelatin (1399), ultraviolet absorbers 2-(2H-benzotriazol-2-yl)-4,6-bis(1,1-dimethylpropyl) phenol (377) and 3-(di-n- dihexylamino) allylidenemalononitrile (130), and arylhydrazide scavenger H (66); and
14) Protective layer: Gelatin (969), a Lippmann silver bromide emulsion (123 Ag), yellow (Carey Lea) silver (2.7 Ag), and bis(vinylsulfonyl)methane hardener (311).

Coupler Y-2

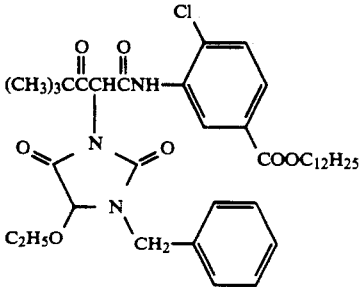

Coupler M-1, R = $CH_3$

-continued

Coupler M-2, R = H

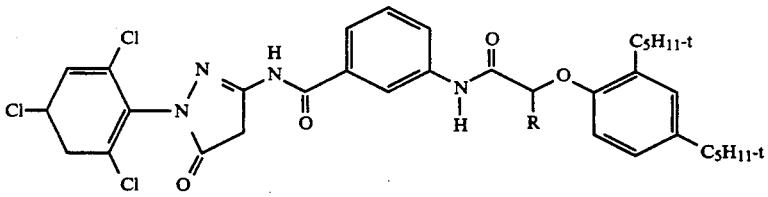

Coupler C.

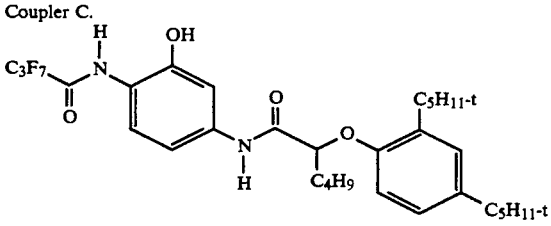

Arylhydrazide H (scavenger/competitor)

N'-{2-[(4-hydroxyphenylsulfonyl)phenoxy]-dodecanoyl}-N-[4-(2-pentyloxy)phenyl]hydrazine.

The slow yellow emulsion consisted of a tabular grain silver bromoiodide emulsion (3.0 mole-% I), having the following properties:

Equivalent circular diameter: 1.07 μm
Mean thickness: 0.087 μm
Coefficient of variation: >25%
Mean aspect ratio: 12.3
Mean tabularity: 141

Tabular grain projected area: 88%, of the total projected area of grains having an ECD of >0.2 μm.

It was optimally sulfur and gold sensitized in the presence of 3-methylbenzothiazolium iodide as a modifier and was spectrally sensitized to the blue region of the spectrum with the monomethine cyanine dye, anhydro-5'-chloro-3,3'-bis(3-sulfopropyl)-naphth [1,2-]oxazolothiacyanine hydroxide, triethylammonium salt.

INVENTION COLOR REVERSAL ELEMENT

A second multicolor reversal element (CR-2) having the same layer sequence as described above and essentially the same composition was prepared, except for the slow yellow emulsion layer 11. This slow yellow emulsion consisted also of a tabular grain silver bromoiodide emulsion (3.0 mole-% I), but having the following grain properties:

Equivalent circular diameter: 1.14 μm
Mean thickness: 0.154 μm
Coefficient of variation: 23%
Mean aspect ratio: 7.4
Mean tabularity: 48

Tabular grain projected area: 98.3%, of the total projected area of grains having an ECD of >0.2 μm.

The preparation of the emulsion is given below. It was chemically and spectrally sensitized by procedures similar to those used for the slow yellow emulsion in control element CR-3.

PREPARATION OF THE SLOW YELLOW EMULSION OF THE INVENTION

In a 4-liter reaction vessel was placed an aqueous gelatin solution (composed of 1 liter of water, 1.3 g of alkali-processed gelatin, 3.7 ml of 4N nitric acid solution, 1.12 g of sodium bromide and having a pAg of 9.39 and 2.92 wt %, based on total silver used in nucleation, of PLURONIC TM 12R3, a surfactant satisfying formula II, x=11, x'=11, y=12) and while keeping the temperature thereof at 45° C., 13.3 ml of an aqueous solution of silver nitrate (containing 1.13 g of silver nitrate) and equal amount of an aqueous solution of sodium bromide (containing 0.69 g of sodium bromide) were simultaneously added thereto over a period of 1 minute at a constant rate. Thereafter, into the mixture was added 14.2 ml of an aqueous sodium bromide solution (containing 1.46 g sodium bromide) after 1 minute of mixing.

The temperature of the mixture was raised to 60° C. over a period of 9 minutes and mixing was continued for another 9 minutes. Then, 83.3 ml of an aqueous gelatin solution (containing 16.7 g of alkali-processed gelatin and 5.8 ml of 2.5N sodium hydroxide solution) was added to the mixture over a period of 2 minutes. After that, 133.3 ml of an aqueous silver nitrate solution (containing 11.32 g of silver nitrate) and 153.2 ml of an aqeous sodium bromide solution (containing 7.85 g of sodium bromide) were added at a constant rate for a period of 20 minutes. Then, 299 ml of an aqueous silver nitrate solution (containing 81.3 g of silver nitrate) and 285.3 ml of an aqueous halide solution (containing 49.7 g of sodium bromide and 2.70 g of potassium iodide) were simultaneously added to the aforesaid mixture at constant ramp starting from respective rate of 2.09 ml/min and 2.07 ml/min for the subsequent 35 minutes. Then. 393 ml of an aqueous silver nitrate solution (containing 106.8 g of silver nitrate) and 373.8 ml of an aqueous halide solution (containing 65.2 g of sodium bromide and 3.47 g of potassium iodide) were simultaneously added to the aforesaid mixture at constant rate over a period of 26.2 minutes. The emulsion was then washed by ultrafiltration.

SHARPNESS COMPARISONS

Standard modulation transfer function (MTF) tests were carried out identically on reversal elements CR-1 and CR-2 as described in U.S. Pat. No. 5,041,367.

TABLE III

Modulation Transfer Function for Elements CR-1 and CR-2

| Frequency (lines/mm) | MTF (%) of CR-1 (control) | MTF (%) of CR-2 (invention) |
|---|---|---|
| 2.5 | 91 | 92 |

TABLE III-continued

| Modulation Transfer Function for Elements CR-1 and CR-2 | | |
|---|---|---|
| Frequency (lines/mm) | MTF (%) of CR-1 (control) | MTF (%) of CR-2 (invention) |
| 5.0 | 85 | 86 |
| 7.5 | 79 | 82 |
| 10.0 | 74 | 76 |
| 15.0 | 62 | 64 |
| 20.0 | 53 | 57 |
| 25.0 | 46 | 51 |
| 30.0 | 43 | 46 |
| 40.0 | 31 | 32 |
| 50.0 | 25 | 27 |
| 60.0 | 19 | 21 |
| 80.0 | 13 | 13 |

As is typical of color reversal photographic elements of the layer structure described above, the cyan dye image record of element CR-1 was significantly lower in sharpness than the yellow and magenta dye image records. This, may be attributed to the fact that the cyan dye image-forming layers are farthest from the exposure source. Reduced cyan image sharpness was particularly noticeable in the frequency range of about to 60 cycles/mm. In that frequency range, the cyan dye image acutance of element, CR-2 was significantly higher than that of CR-1, with the MTF response ranging from 2 to 5 percent higher, with an overall MTF advantage in that frequency range of approximately 3 percent. In element CR-2 the sharpness of the cyan dye image record more nearly approached that of the yellow and magenta image records.

The following examples are the emulsions prepared for the multicolor reversal elements of Example 21.

EXAMPLE 17 (SHK-556)

A 3% iodide silver bromoiodide tabular grain emulsion of the invention was precipitated by a double jet procedure. The following procedure produced 1 mole of total silver precipitation. 0.0165 mole of silver was nucleated for 1 min. by 2N silver nitrate while maintaining pAg 9.7 by adding the halide salt solution A (1.98N sodium bromide and 0.02N potassium iodide) to a vessel filled with 818 ml aqueous solution containing 5 g/bone gelatin, 2.5 g/sodium bromide, and 0.44 ml/of PLURONIC TM 31R1, a surfactant satisfying o formula II, x=25. x'=25, and y=7, at pH 1.85 and at 45° C. After adjusting the pAg to 9.8 with sodium bromide, the temperature was raised to 60° C. and 13.85 ml of 0.77N ammonium sulfate was added. The pH was brought to 10.0 by 2.5N sodium hydroxide. After holding for 9 min., the pAg was adjusted to 9.2 by addition of aqueous gelatin solution containing 100 g/bone gelatin, and 0.11 ml/1 PLURONICTM TM 31, and then adjusting the pH to 5.8. The grains were then grown at pAg 9.2 for 55.8 min by accelerated flows of 1.6N silver nitrate and a halide solution B (1.66N sodium bromide and 0.0168N potassium iodide). At this point, which completed 71% of the total silver precipitation, a preformed silver iodide emulsion (0.05 μm) was added to make a total of 3 mole-% iodide. After 3 min.. the remaining 29% of total silver was precipitated with 1.6N silver nitrate and 1.68N sodium bromide at pAg 8.7 for 13.3 min. The resultant emulsion was washed by an ultrafiltration technique and the pH and pAg adjusted to 5.5 and 8.2, respectively. The properties of grains of this emulsion were as follows:

Equivalent circular diameter: 1.00 μm
Mean thickness: 0.142 μm
Coefficient of variation: 19.5%
Mean aspect ratio: 7.0
Mean tabularity: 49.3
Tabular grain projected area: >99%.

This emulsion was optimally sulfur- and gold-sensitized and spectrally sensitized in the blue region with 880 mg/Ag mole of anhydro-5 -chloro-3,3'-bis(3 -sulfopropyl)naphth [1,2-d]oxoazolothiacyanine hydroxide, triethylammnoium salt.

Example 18

A second 3% iodide silver bromoiodide tabular grain emulsion according to the invention was prepared like Example 13 with the following modifications: The first 1 minute of precipitation was carried out with 48% of silver nitrate and sodium bromide and one half of the oxidized gelation at pH 1.85; the pH raised by the ammoniacal solution was 9.0; the pH for grain growth was 5.8. The properties of grains of this emulsion were as follows:

Equivalent circular diameter: 1.61 μm
Mean thickness: 0.139 μm
Coefficient of variation: 17.4
Mean aspect ratio: 11.6
Mean tabularity 83.3
Tabular grain projected area: >99%.

The emulsion was chemically and spectrally sensitized like Example 13, omitting the methylsulfamoylethyl-benzothiazolium salt.

EXAMPLE 19

A conventional 4% iodide silver bromoiodide tabular grain emulsion (not of the invention), having relatively small ECD and low aspect ratio, was made according to the method described in U.S. Pat. No. 4,425,426. The emulsion had the following properties:

Equivalent circular diameter: 0.54 μm
Mean thickness: 0.097 μm
Coefficient of variation: 31%
Mean aspect ratio: 5.6
Mean tabularity: 57.4
Tabular grain projected area: 88%.

The emulsion was chemically and spectrally sensitized as in Example 17, except that the amounts of chemical sensitizers and spectral sensitizing dye were increased by 50%.

EXAMPLE 20

A conventional 3% iodide silver bromoiodide tabular grain emulsion (not of the invention) like the emulsion used for CR-1 in Example 16. The emulsion had the following properties:

Equivalent circular diameter: 1.07 μm
Mean thickness: 0.086 μm
Coefficient of variation: 34%
Mean aspect ratio: 12.4
Mean tabularity: 144.7
Tabular grain projected area: 88%.

The emulsion was optimally chemical and spectrally sensitized with anhydro-5'-chloro-3,3'-bis(3-sulfopropyl)naphth[1,2-d]oxazolothiacyanine hydroxide, triethylammonium salt.

EXAMPLE 21

Four multilayer color reversal elements are compared showing an improvement in sharpness when the elements of the invention (CR-3 & -4) contain in both of their yellow layers a tabular grain emulsion in which the tabular grains account for greater than 97% of the total projected area of grains having an equivalent circular diameter of at least 0.2 μm. The control elements (CR-5 & -6) have in their yellow layers a corresponding emulsion in which the tabular grains account for less than 97%. Element CR-3 was coated in the following sequential layers on a cellulose ester support:

1) Antihalation layer: Gelatin (2410) containing gray silver (430);
2)Interlayer: Gelatin (1216);
3) Slow cyan emulsion layer: Gelatin (861), red-sensitive conventional tabular grain silver bromoiodide (3% I) emulsion (484 Ag), a dispersion of cyan dye-forming coupler C (215) in dibutyl phthalate (108);
4) Fast cyan emulsion layer: Gelatin (1506), red-sensitive conventional tabular grain silver bromoiodide (4% I) emulsion (538 Ag), and a dispersion of cyan dye-forming coupler C (968) in dibutyl phthalate (484);
5) Interlayer: Interlayer: Gelatin (613), arylhydrazide oxidized developer scavenger H (161), and green-absorbing dye 1,3-bis[(1-{4-carboxyphenyl}-3-methyl-2-pyrazolin-5-one (4)]trimethineoxonol (65);
6) Interlayer: Gelatin (613);
7) Slow magenta emulsion layer: Gelatin (861), green-sensitive conventional tabular grain silver bromoiodide (4% I) emulsion (484 Ag), and a dispersion of magenta dye-forming couplers M-1 (114) and M-2 (49) in tricresyl phosphate (81);
8) Fast magenta emulsion layer: Gelatin (1507), green-sensitive conventional tabular grain silver bromoiodide (4% I) emulsion (430 Ag), and a dispersion of magenta dye-forming couplers M-1 (678) and M-2 (291) in tricresyl phosphate (484);
9) Interlayer: Gelatin (613);
10) Interlayer: Gelatin (613), arylhydrazide oxidized developer scavenger H (108), and blue absorber 4-(4-(butanesulfonamidophenyl)-3-cyano-5-furfuryl-idene-2,5-dihydro-2-furanone (269);
11) Slow yellow emulsion layer: Gelatin (861) and the blue-sensitive, tabular grain silver bromoiodide (3% I) emulsion (538 Ag) described in Example 17; the layer also contained a dispersion of yellow dye-forming coupler Y-2 (269) in dibutyl phthalate (135);
12) Fast yellow emulsion layer: Gelatin (2367), the blue-sensitive, tabular grain silver bromoiodide (3% I) emulsion (538 Ag) described in Example 17 (538 Ag), and a dispersion of yellow dye-forming coupler Y-2 (1560) in dibutyl phthalate (780);
13) Protective layer: Gelatin (1399), ultraviolet absorbers 2-(2H-benzotriazol-2-yl)-4,6-bis(1,1-dimethylpropyl) phenol (377) and 3-(di-n-dihexylamino) allylidenemalononitrile (130); and
14) Protective layer: Gelatin (969), and bis(vinylsulfonyl) methane hardener (279).

Element CR-4 and control elements CR-5 and CR-6 contained the emulsions of Examples 18, 19, and 20, respectively, coated at the same level of silver.

The coated samples were exposed through a step tablet, a Wratten 2B TM filter and a 1.0 neutral density filter to a 5500° K light source for 1/50th second and then processed in the Kodak Ektachrome TM E6 process described in the *British Journal of Photography*, 1977, 194–197.

The image sharpness was evaluated by determining the modulation transfer function (MTF) and comparing at 50 cycles/mm. The cascaded MTF response (CMT) for 35mm slides was calculated from the MTF response and also compared for each sample. The results are shown in Table IV.

TABLE IV

| | | Sharpness and Speed of the Red and Green Layers | | | | | |
|---|---|---|---|---|---|---|---|
| Element | TGPA* | CMT-Red Layer | CMT-Grn Layer | MTF-Red Layer | MTF-Grn Layer | Rel. Red Log E Speed | Rel. Grn Log E Speed |
| CR-3 (Inv.) | >99% | 96.8 | 98.1 | 30 | 48 | 101 | 107 |
| CR-4 (Inv.) | >99% | 97.5 | 98.3 | 34 | 52 | 100 | 105 |
| CR-5 (Cont) | 88% | 95.5 | 97.5 | 22 | 37 | 100 | 104 |
| CR-6 (Cont) | 88% | 96.3 | 97.8 | 28 | 45 | 92 | 97 |

*tabular grain projected area as a percentage of total grain projected area in the emulsions of Examples 17 (CR-3), 18 (CR-4), 19 (CR-5) and 20 (CR-6).

The values in Table IV show that the elements CR-3 and CR-4 of the invention are markedly improved in sharpness (CMT & MTF) in the definitive red and green layers and improved speed over the control elements CR-5 and CR 6.

The invention has been described in detail with particular reference to preferred embodiments thereof, but it will be understood that variations and modifications can be effected within the spirit and scope of the invention.

What is claimed is:

1. A multicolor photographic element capable of forming a viewable reversal dye image comprising
a support and, coated on said support,
a blue recording yellow dye image forming layer unit,
a green recording magenta dye image forming layer unit, and
a red recording cyan dye image forming layer unit,
each of the dye image forming layer units containing at least one silver halide emulsion layer comprised of a vehicle and silver halide grains having a halide content of from 0 to 5 mole percent chloride, from 0.1 to 20 mole percent iodide, and from 80 to 99.9 mole percent bromide, based on total silver,
CHARACTERIZED IN THAT at least one of the silver halide emulsion layers in one of the layer units positioned to receive exposing radiation prior to at least one of the green or red recording layer units is a tabular grain emulsion layer in which
a polyalkylene oxide block copolymer is present selected to satisfy one of the formulae

LAO1—HAO1—LAO1, (S-I)

HAO2—LAO2—HAO2, (S-II)

$(H—HAO3)_z—LOL—(HAO3—H)_{z'}$, (S-III)

and $(H—LAO4)_z—HOL—(LAO4—H)_{z'}$ (S-IV)

where

LAOl and LAO4 in each occurrence represents a terminal lipophilic alkylene oxide block unit, HAO2 and HAO3 in each occurrence presents a terminal hydrophilic alkylene oxide block unit, HAO1 and HOL each represents a hydrophilic alkylene oxide block linking unit, LAO2 and LOL each represents a lipophilic alkylene oxide block linking unit, z is 2, and z' is 1 or 2, each block linking unit constitutes from 4 to 96 percent of the block copolymer on a weight basis, the block copolymer S-I has a molecular weight of from 760 to less than 16,000, the block copolymer S-II has a molecular weight of from 1,000 to 30,000, the block copolymer S-III has a molecular weight of from 1,100 to 60,000, and the block copolymer S-IV has a molecular weight of 1,100 to 50,000, the tabular grains account for greater than 97 percent of the total projected area of grains having an equivalent circular diameter of at least 0.2 μm and the tabular grains have a mean thickness of less than 0.3 μm and a mean tabularity of greater than 25.

2. A multicolor photographic element capable of forming a viewable reversal dye image according to claim 1 further characterized in that the at least one tabular grain emulsion layer is located in the blue recording yellow dye image forming layer unit.

3. A multicolor photographic element capable of forming a viewable reversal dye image according to claim 2 further characterized in that the at least one blue recording yellow dye image forming layer unit is located to overlie the green and red image forming layer units.

4. A multicolor photographic element capable of forming a viewable reversal dye image according to claim 1 further characterized in that the tabular grains have an average aspect ratio of up to 100.

5. A multicolor photographic element capable of forming a viewable reversal dye image according to claim 4 further characterized in that the tabular grains have an average aspect ratio in the range of from 5 to 50.

6. A multicolor photographic element capable of forming a viewable reversal dye image according to claim 1 further characterized in that the tabular grains are comprised of from 1 to 15 mole percent iodide, based on total silver.

7. A multicolor photographic element capable of forming a viewable reversal dye image according to claim 1 further characterized in that the tabular grains are silver bromoiodide grains.

8. A multicolor photographic element capable of forming a viewable reversal dye image according to claim 1 further characterized in that the tabular grains contain less than 10 mole percent iodide.

9. A multicolor photographic element capable of forming a viewable reversal dye image according to claim 1 further characterized in that (a) each lipophilic alkylene oxide block contains repeating units satisfying the formula:

$$-(OC\overset{R^9}{\overset{|}{H}}CH_2)-$$

where $R^9$ is a hydrocarbon containing from 1 to 10 carbon atoms, and (b) each hydrophilic alkylene oxide block contains repeating units satisfying the formula:

$$-(OC\overset{R^{10}}{\overset{|}{H}}CH_2)-$$

where $R^{10}$ is hydrogen or a hydrocarbon containing from 1 to 10 carbon atoms substituted with at least one polar substituent.

10. A multicolor photographic element capable of forming a viewable reversal dye image according to claim 1 further characterized in that the polyalkylene oxide block copolymer satisfies the formula:

$$HO-(C\overset{CH_3}{\overset{|}{H}}CH_2O)_x-(CH_2CH_2O)_y-(CH_2C\overset{CH_3}{\overset{|}{H}}O)_{x'}-H$$

where x and x' are each in the range of from 6 to 120 and y is in the range of from 2 to 300.

11. A multicolor photographic element capable of forming a viewable reversal dye image according to claim 1 further characterized in that the polyalkylene oxide block copolymer satisfies the formula:

$$HO-(CH_2CH_2O)_{y'}-(C\overset{CH_3}{\overset{|}{H}}CH_2O)_x-(CH_2CH_2O)_{y'}-H$$

where x is in the range of from 13 to 490 and y and y' are in the range of from 1 to 320.

12. A multicolor photographic element according to claim 1 further characterized in that the tabular grains have a mean thickness of less than 0.2 μm and the vehicle is comprised of a gelatino-peptizer containing at least 30 micromoles per gram of methionine and a polyalkylene oxide block copolymer surfactant having a molecular weight in the range of from 760 to 16,000 satisfying the formula:

LAO1—HAO1—LAO1 where

LAO1 in each occurrence represents a terminal lipophilic alkylene oxide block unit containing at least six $—CH(CH_3)CH_2O—$ repeating units and HAO1 represents a hydrophilic alkylene oxide block linking unit containing $—CH_2CH_2O—$ repeating units forming 5 to 85 percent of the total surfactant molecular weight.

13. A multicolor photographic element capable of forming a viewable reversal dye image according to claim 12 further characterized in that the polyalkylene oxide block copolymer surfactant has a molecular weight in the range of from 1000 to 10,000, LAO1 in each occurrence contains at least seven —$CH(CH_3)CH_2O$ — repeating units, and HAO1 forms from 10 to 80 percent of the total surfactant molecular weight.

14. A multicolor photographic element according to claim 1 further characterized in that the tabular grains have a mean thickness of less than 0.2 μm and the vehicle is comprised of a gelatino-peptizer containing less than 30 micromoles per gram of methionine and a polyalkylene oxide block copolymer surfactant having a molecular weight in the range of from 760 to 16,000 satisfying the formula:

LAO1—HAO1—LAO1 where

LAO1 in each occurrence represents a terminal lipophilic alkylene oxide block unit containing at least six —$CH(CH_3)CH_2O$— repeating units and HAO1 represents a hydrophilic alkylene oxide block linking unit containing —$CH_2CH_2O$— repeating units forming 4 to 35 percent of the total surfactant molecular weight.

15. A multicolor photographic element capable of forming a viewable reversal dye image according to claim 14 further characterized in that the polyalkylene oxide block copolymer surfactant having a molecular weight in the range of from 1000 to 10,000, LAO1 in each occurrence contains at least seven —$CH(CH_3)CH_2O$— repeating units and HAOl forms from 10 to 30 percent of the total surfactant molecular weight.

16. A multicolor photographic element according to claim 1 further characterized in that the tabular grains have a mean thickness of less than 0.2 μm and the vehicle is comprised of a gelatino-peptizer containing at least 30 micromoles per gram of methionine and a polyalkylene oxide block copolymer surfactant having a molecular weight in the range of from 800 to 30,000 satisfying the formula:

HAO2—LAO2—HAO2 where

HAO2 in each occurrence represents a terminal hydrophilic alkylene oxide block unit and LAO2 represents a lipophilic alkylene oxide block linking unit, contains at least thirteen —$CH(CH_3)CH_2O$— -repeating units, and accounts for from 15 to 95 percent of the total surfactant molecular weight.

17. A multicolor photographic element capable of forming a viewable reversal dye image according to claim 16 further characterized in that the polyalkylene oxide block copolymer surfactant has a molecular weight in the range of from 1000 to 20,000 and LAO2 accounts for from 20 to 90 percent of the total surfactant molecular weight.

18. A multicolor photographic element according to claim 1 further characterized in that the tabular grains have a thickness of less than 0.2 μm and the vehicle is comprised of a gelatino-peptizer which contains less than 30 micromoles per gram of methionine and a polyalkylene oxide block copolymer surfactant having a molecular weight in the range of from 800 to 30,000 satisfying the formula:

HAO2—LAO2—HAO2 where

HAO2 in each occurrence represents a terminal hydrophilic alkylene oxide block linking unit containing —$CH_2CH_2O$— repeating units and LAO2 represents a lipophilic alkylene oxide block linking unit containing at least thirteen —$CH(CH_3)CH_2O$— -repeating units and accounting for from 40 to 96 percent of the total surfactant molecular weight.

19. A multicolor photographic element capable of forming a viewable reversal dye image according to claim 18 further characterized in that the polyalkylene oxide block copolymer surfactant has a molecular weight in the range of from 1000 to 20,000 and LAO 02 represents 60 to 90 percent of the total surfactant molecular weight.

20. A multicolor photographic element according to claim, 1 further characterized in that tabular grains in the at least one tabular grain emulsion layer account for greater than 98 percent of the total projected area of grains having an equivalent circular diameter of at least 0.2 μm.

21. A multicolor photographic element according to claim 20 further characterized in that tabular grains in the at least one tabular grain emulsion layer account for greater than 98 percent of the total projected area of grains having an equivalent circular diameter of at least 0.15 μm.

* * * * *